US006442877B1

(12) United States Patent
Quenzi et al.

(10) Patent No.: US 6,442,877 B1
(45) Date of Patent: Sep. 3, 2002

(54) PLOW WITH REAR MOUNTED, ADJUSTABLE WING

(75) Inventors: Philip J. Quenzi, Atlantic Mine, MI (US); Cal G. Niemela, Chassell, MI (US); Curt E. Niemela, Chasell, MI (US)

(73) Assignee: Blizzard Corporation, Calumet, MI (US)

( * ) Notice: Subject to any disclaimer, the term of this patent is extended or adjusted under 35 U.S.C. 154(b) by 0 days.

(21) Appl. No.: 09/689,004

(22) Filed: Oct. 12, 2000

(51) Int. Cl.[7] ..... C01H 5/06
(52) U.S. Cl. ..... 37/281
(58) Field of Search ..... 37/241, 274, 281–283, 37/234, 232, 266, 279, 903; 172/782, 786, 815, 816, 684.5

(56) References Cited

U.S. PATENT DOCUMENTS

| | | | | |
|---|---|---|---|---|
| 595,202 | A | 12/1897 | Pearson et al. | |
| 1,927,078 | A | 9/1933 | Weeks | 37/44 |
| 2,218,512 | A | 10/1940 | Ball | 37/42 |
| 2,299,451 | A | 10/1942 | Austin | 37/44 |
| 2,410,543 | A | 11/1946 | Kester | 37/44 |

(List continued on next page.)

FOREIGN PATENT DOCUMENTS

| | | |
|---|---|---|
| DE | 919474 | 7/1949 |
| EP | 140139 | 5/1985 |
| GB | 1037674 | 8/1966 |
| SE | 323974 | 5/1970 |

OTHER PUBLICATIONS

Commonly Assigned Co–Pending U.S. Patent Application, Serial No. 09/243,908, filed Feb. 3, 1999 by Philip J. Quenzi et al. for Plow Hitch Assembly for Vehicles.

*Farm Industry News*, vol. 23, No. 7, Jul./Aug. 1990, p. 25. Publication "Still Out Front in Productivity," Excel Industries, Inc., © 1988.

(List continued on next page.)

*Primary Examiner*—Robert E. Pezzuto
(74) *Attorney, Agent, or Firm*—Van Dyke, Gardner, Linn & Burkhart, LLP

(57) ABSTRACT

A plow assembly for vehicles such as pickup trucks and tractors for moving snow or other materials, as well as for bulldozers, graders and the like for excavating and grading dirt, sand, gravel or other plowable materials, has at least one extendable, forwardly pivotable plow wing which is extendable on one end of a main plow by sliding movement along the rear of the plow between a retracted and an extended position in which the plow wing is generally aligned with the plow front surface. The plow wing is also pivotally mounted on a hinge for movement between the extended position and a forwardly angled position in which the plow wing front surface extends at an angle to the plow front surface. At least one actuator, such as an hydraulic fluid power cylinder, is connected to the plow wing to move the wing between the retracted, extended and forwardly angled positions. In a preferred embodiment, an extendable plow wing is included on each end of the main plow with at least one actuator connected to each of the respective plow wings. Optionally, each plow wing may be movable via a pair of actuators, whereby the actuators in each respective pair are operable independently of one another to move the plow wings independently between their respective retracted, extended and forwardly angled positions. When both plow wings are pivoted to their forwardly angled positions, the plow assembly has a general U-shape which facilitates pushing snow, dirt, sand or other plowable material without the material slipping off the plow blade ends. The main plow may include a section formed from polymeric sheet material for weight reduction. Because the plow wings are movable along the rear surface of the plow, the front surface of the plow provides a substantially continuous, uninterrupted surface for moving the plowed material therealong.

50 Claims, 12 Drawing Sheets

U.S. PATENT DOCUMENTS

| | | | | |
|---|---|---|---|---|
| 2,524,329 | A | 10/1950 | Richardson | 37/44 |
| 2,643,470 | A | 6/1953 | Kaeser | |
| 3,157,099 | A | 11/1964 | Ulrich | |
| 3,250,026 | A | 5/1966 | Jocher et al. | 37/42 |
| 3,302,317 | A | 2/1967 | Domres | 37/179 |
| 3,378,084 | A | 4/1968 | Ulrich | 172/247 |
| 3,425,497 | A | 2/1969 | Strabala et al. | 172/792 |
| 3,430,706 | A | 3/1969 | Marron | 172/802 |
| 3,477,151 | A | 11/1969 | Zanella | 37/42 |
| 3,657,828 | A | 4/1972 | Anderson | 37/46 |
| 3,775,877 | A | 12/1973 | Gove, Sr. | 37/42 |
| 3,803,733 | A | 4/1974 | Ramsey | 37/44 |
| 3,807,064 | A | 4/1974 | Schmidt, Jr. | 37/41 |
| 4,019,268 | A | 4/1977 | Waterman | 37/10 |
| 4,073,077 | A | 2/1978 | Essel et al. | 37/50 |
| 4,074,448 | A | 2/1978 | Niemela | 37/41 |
| 4,099,578 | A | 7/1978 | Stevens | 172/802 |
| 4,145,825 | A | 3/1979 | Bertolino | 37/42 |
| 4,196,532 | A | 4/1980 | Muller | 37/105 |
| 4,249,323 | A | 2/1981 | Mathis et al. | 37/42 |
| 4,275,514 | A | 6/1981 | Maura | 37/42 |
| RE31,045 | E | 10/1982 | Essell et al. | 37/281 |
| 4,356,645 | A | 11/1982 | Hine et al. | 37/281 |
| 4,369,847 | A | 1/1983 | Mizunuma | 172/815 |
| 4,372,617 | A | 2/1983 | Zamboni | 229/24 |
| 4,479,312 | A | 10/1984 | Turgeon | 31/219 |
| B14,356,645 | A | 11/1984 | Hine et al. | 37/281 |
| 4,614,048 | A | 9/1986 | Melby | 37/280 |
| 4,658,519 | A | 4/1987 | Quenzi | 37/23 |
| 4,667,426 | A | 5/1987 | Howard et al. | 37/232 |
| 4,723,609 | A | 2/1988 | Curtis | 172/815 |
| 4,779,363 | A | 10/1988 | Boutrais et al. | 37/117 |
| 4,834,191 | A | 5/1989 | Vecchio | 172/784 |
| 4,962,600 | A | 10/1990 | Zellaha et al. | 37/280 |
| 5,165,191 | A | 11/1992 | Davis | 37/117.5 |
| 5,285,588 | A | 2/1994 | Niemela et al. | 37/234 |
| 5,375,349 | A | 12/1994 | Jochim | 37/429 |
| 5,392,538 | A | 2/1995 | Geerligs et al. | 37/268 |
| 5,411,102 | A | 5/1995 | Nickels et al. | 172/781 |
| 5,638,618 | A | 6/1997 | Niemela et al. | 37/281 |
| 5,829,174 | A | 11/1998 | Hadler et al. | 37/234 |
| 5,899,007 | A | 5/1999 | Niemela et al. | 37/281 |

OTHER PUBLICATIONS

"Snow Track 440," Publication, Excel Industries, 1989.

Snow Craft Industries, Inc. Publication, Sedalla, Colorado, published more than one year prior to the filing date of this application –(No date).

Commonly Assigned, Co–Pending U.S. Patent Application, Serial No. 09/689,494, filed Oct. 12, 2000 by Philip J. Quenzi et al., for Adjustable Wing Plow.

Commonly Assigned, Co–Pending U.S. Patent Application, Serial No. 09/689,524, filed Oct. 12, 2000 by Philip J. Quenzi et al., for Adjustable Wing Plow with Fixed Pivot.

PLOW WITH REAR MOUNTED, ADJUSTABLE WING

FIELD OF THE INVENTION

The present invention relates to plows fitted on vehicles for moving snow, dirt, sand, gravel and other plowable, excavatable materials and, more particularly, to a plow for snow and other materials for use with pickup trucks and other vehicles having plow wings which are individually adjustable for both extension of the main plow and forward angling for positioning the plow to prevent snow or other plowed material from slipping off the ends of the plow.

BACKGROUND OF THE INVENTION

A wide variety of snow plows for pickup trucks and other vehicles are available and in use. These include straight bladed plows of the type shown in U.S. Pat. No. 3,250,026, and center-hinged, V-plows of the type shown in U.S. Pat. Nos. 4,074,448 and 4,658,519. Other straight bladed plows have been devised with one or both ends being slidably extendable as shown in U.S. Pat. No. 2,218,512; U.S. Pat. No. 3,807,064; and Swedish 323,974. Yet other plows have included straight blades with pivotable, non-extendable ends as shown in U.S. Pat. Nos. 4,145,825 and 3,477,151. At least one plow is shown in EPO 140,139 having permanently forwardly angled plow ends, which forwardly angled plow ends include slidable extensions wherein the entire plow swings from side to side so as to angle the entire plow left or right.

While each of the above types of prior known plows is useful in one or more situations, the overall flexibility for use of these plows has been limited. For example, for truck mounted plows which must be transported from one site to another for clearing snow or other plowable materials, it is necessary that the plow be short enough to allow transport on public highways which have limited lane width. However, when actually engaged in plowing, it is very helpful to have a greater length for the plow so that larger areas of the parking lot or other site can be cleared of snow more quickly. Yet another problem encountered is when large amounts of snow or other plowable material must be pushed or carried with the plow from one area of a clearing site to another such as the side of a parking lot. Many of the above mentioned plows allow the snow or other material being cleared to slip off the ends of the plow thereby requiring additional time and work to completely clear the site.

Plows have been proposed which provide adjustable wings which are extendable and retractable and may be pivoted forwardly from their extended positions to form a generally U-shaped plow. For example, such plows are disclosed in U.S. Pat. Nos. 5,638,618 and 5,899,007. The plow moldboard of these plows has an opening or slot therealong to connect the plow wings and pivot hinges to the plow assembly, such that the plow wings are slidable along a front surface of the plow between an extended and retracted position.

Many existing, prior known plows have, therefore, failed to provide a plow with sufficient flexibility to handle the varying needs encountered in plowing using pickup trucks or other vehicles, especially when such vehicles must be driven on public highways, or when excavating or grading using a bulldozer, grader or the like. Such needs include a short enough plow length to allow transportation on public highways, a long enough length for fast, efficient clearing of a job site, and the carrying or pushing of snow, dirt, sand, gravel or the like from one area to another without allowing snow or other material to slip off the plow ends. In addition, plows should be as light in weight as possible while sufficiently strong to withstand the various forces imposed thereon during plowing of various materials, should allow for proper visibility during use as well as when moved to a non-use position on the vehicle, and should allow ease in repair or replacement of those parts subject to high wear during plowing use. All of these results should be accomplished while minimizing the size and space required for the plow in each of its arrangements.

SUMMARY OF THE INVENTION

The present invention provides a plow having adjustable wings on its ends which can be adjusted to varying positions to allow transport on public highways, to provide increased plow length for fast, efficient clearing of snow or other materials being plowed, and to allow carrying or pushing of plowable material from one area to another without the plowed material slipping off the plow ends. The present plow may be configured in various arrangements to handle each of these situations while minimizing the size and space required by the plow when in position on the vehicle. The present plow also allows adjustment to meet these various situations from a remote position in the cab of the vehicle without external, hands on adjustment.

According to an aspect of the present invention, a plow assembly for vehicles comprises a plow, a support for attaching the plow to the vehicle, an extendable plow wing, and at least one actuator for moving the plow wing between an extended and retracted position along a rear surface of the plow and for pivoting the plow wing forwardly with respect to the plow. The plow includes first and second ends, a front material engaging surface, and the rear surface opposite said front surface. The plow wing has inner and outer ends, a front material engaging surface, and a rear surface opposite the front surface. The plow wing is mounted for sliding movement along the rear surface of the plow at the first end between a retracted position, in which the outer end of the plow wing is adjacent the first end of the plow, and an extended position, in which the outer end of the plow wing is spaced outwardly of the first end of the plow with the front surface of the plow wing being generally aligned with the plow front surface. The plow wing includes a hinge and is pivotally mounted on the hinge for movement between an aligned position in which the front surface of the plow wing is generally aligned with the front surface of the plow, and a forwardly angled position in which the front surface of the plow wing extends at an angle to the plow front surface. The actuator is operable to move the plow wing between the retracted and the extended positions and is further operable to move the plow wing between the aligned position and the forwardly angled position.

Preferably, the plow assembly includes a plow wing at each end of the plow. Both plow wings are movable between the extended and retracted positions and further movable between the aligned and forwardly angled positions with respect to the plow. Optionally, the plow assembly may include two pair of actuators, such as hydraulic cylinders or the like. Each pair of actuators is operable to move one of the plow wings with respect to the plow. One of the actuators of each pair is operable to move the respective plow wing along the rear surface of the plow between the extended and retracted positions, while the other actuator of the pair is operable to move or pivot the respective plow wing about the hinge between the aligned and forwardly angled positions. Preferably, the actuators are controlled such that the second actuator is not actuated to pivot the plow wing until after the plow wing or wings has/have been fully extended to the extended position by the first actuator.

According to another aspect of the present invention, a plow assembly for vehicles comprises a plow, a support frame for attaching the plow to the vehicle, a pair of plow wings at opposite ends of the plow, a pair of slides, which are movable along a rear surface of the plow, and at least two actuators, at least one of the actuators being operable to move a respective one of the plow wings relative to the plow. The plow includes a front material engaging surface, which provides a generally continuous surface for engaging and moving material, such as snow, dirt, sand or the like. The plow is pivotally mounted on the support frame for movement about a first, generally vertical pivot axis from a centered position extending generally transverse to a longitudinal axis of the vehicle to a series of angled positions in which the plow is angled to the left or right of the centered position. Each of the plow wings preferably has a cross-sectional contour corresponding to the plow and is mounted for sliding movement along a rear surface of the plow. Each of the plow wings is movable between a retracted position, in which an outer end of the plow wing is adjacent its respective end of the plow, and an extended position, in which the outer end of the plow wing is spaced outwardly from its respective end of the plow. Each of the plow wings is generally aligned with the plow front surface as it moves between the retracted and extended positions. Each plow wing also includes a hinge and is pivotally mounted on the hinge for movement between the extended position and a forwardly angled position in which the wing front surface extends at an angle to the plow front surface. Each plow wing and corresponding hinge is mounted on and movable with the respective slide, which is slidably movable along the rear surface of the plow. Each of the plow wings is operable independently of the other plow wing such that the plow wings are independently movable between the respective, retracted, extended, and forwardly angled positions.

Optionally, the plow includes two pair of actuators, whereby one pair of the two pair of actuators is operable to move one of the plow wings, and the other pair of actuators is operable to move the other plow wing. Preferably, one of the actuators of each pair of actuators is operable to move the slide, and thus the hinge and plow wing, along the rear of the plow between the extended and retracted positions, while the other of the actuators of each pair is operable to move or pivot the plow wing about the hinge between the extended and forwardly angled positions.

Accordingly, the plow assembly of the present invention provides numerous advantages over prior known plows. The present plow assembly has sufficient flexibility to handle varying needs including being short enough in length when not extended to allow transport on public highways without projecting into adjacent lanes, being extendable to a sufficient length to allow fast, efficient clearing of snow or other material being plowed from a large area, and yet being configurable with either one or both of the extendable ends angled forwardly for highly efficient carrying and/or pushing of plowed material from one location in the area being plowed to another without the plowed material slipping off the plow ends. All of these functions are accomplished by the present plow assembly with minimal size and space due to its compact and efficient construction. The plow may be centered for pushing or carrying of snow or other plowed material, or angled to one side or the other for moving snow or other material to the side of the vehicle supporting the plow. One or both plow wings at the ends of the plow may be extended or pivoted forwardly independently or together, while the entire plow may be centered or angled to one side or the other with one or both of the plow wings extended or pivoted forwardly. In either case, the plow wings at either end of the main plow are independently extendable and movable to a forwardly angled position via remote control from the cab of the vehicle by means of actuators, such as hydraulic fluid cylinders, mounted along the back of the plow. Either a single fluid cylinder or a pair of fluid cylinders may be mounted to move each plow wing with respect to the plow. The main plow blade provides a generally continuous, uninterrupted surface, since the plow wings and slides are mounted at and movable along the rear surface of the plow, such that the plow does not require any openings or movable components at its front, material engaging surface to move or pivot the plow wings with respect thereto. This avoids the possibility of dirt, ice, or other materials becoming lodged in the movable mechanisms of the plow wings, since these mechanisms are positioned entirely behind the uninterrupted moldboard of the plow. The continuous front surface of the plow thus prevents the plowed material from being packed into the moving components, such as the hinges and slides, as the plow engages such materials, even when the plow wings are partially or fully extended and/or pivoted relative to the plow. This not only may improve the operation of the plow wings when plowing or excavating, but may also increase the life cycle of the plow wings and their associated components.

In addition, both the main plow and the extendable wings pivot forwardly on a horizontal axis in the event an obstacle is encountered during plowing. Further, when the plow wings are extended, if the vehicle is moved in reverse and a quantity of snow or other material being plowed engages the rear surface of either plow wing, either a latch mechanism, the main plow blade, or a fluid cylinder maintains the plow wing in alignment with the plow blade and prevents movement to the forwardly angled position until desired. In addition, the extendable, adjustable plow of the present invention has been designed in a highly compact, lightweight manner allowing use on a wide variety of pickup trucks, utility vehicles, tractors and other vehicles as well, including bulldozers, graders, or other excavation or construction vehicles. It may be supported at the front of a vehicle via the preferred support frame or by means such as vertical supports positioned behind the plow assembly such as in a road grader. In addition, the plow assembly of the present invention is rugged, strong and highly durable to allow use in harsh weather or environmental conditions over an extended period of time.

These and other objects, advantages, purposes and features of the invention will become more apparent from a study of the following description taken in conjunction with the drawings.

DESCRIPTION OF THE PREFERRED EMBODIMENTS

Figure 1:
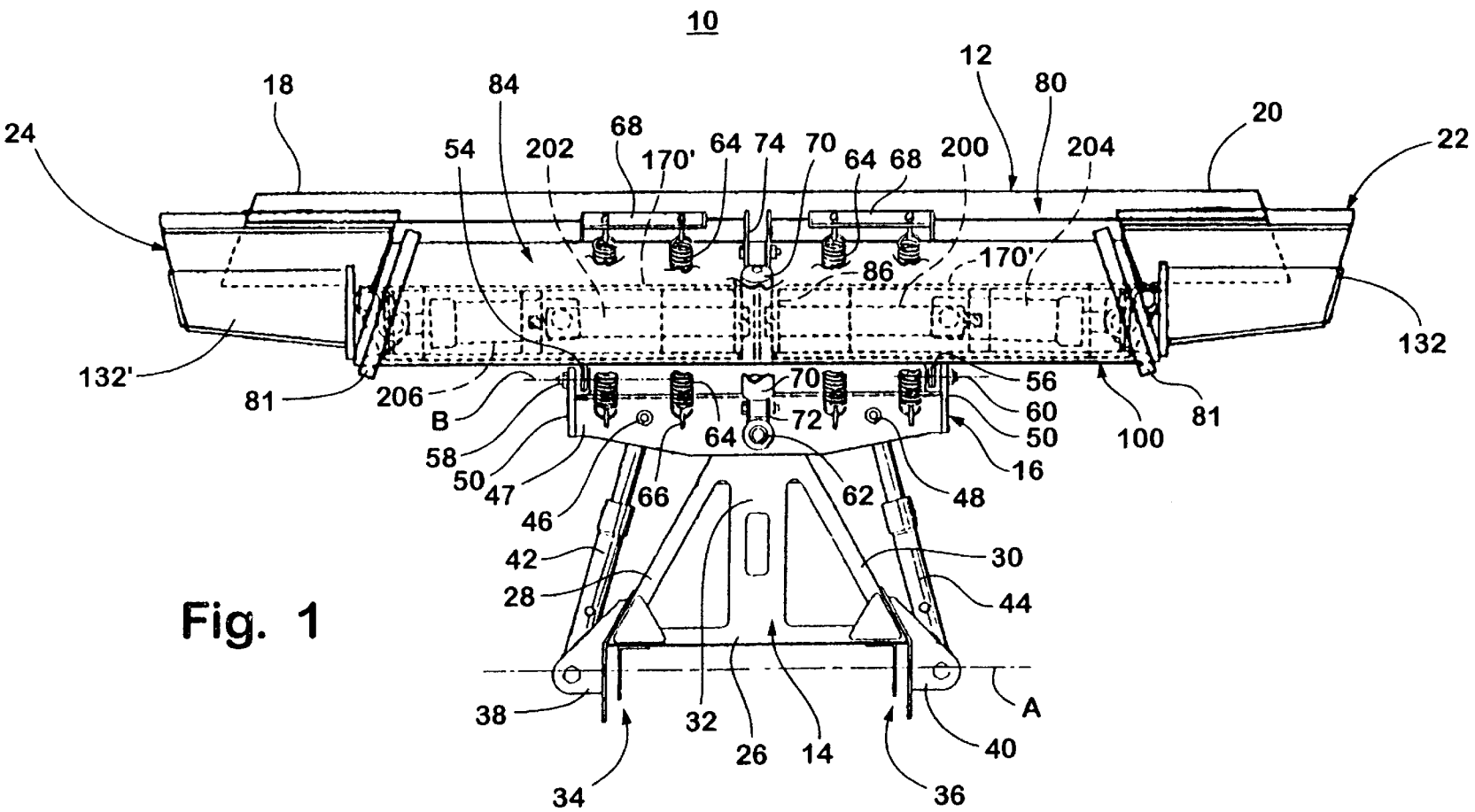
FIG. 1 is a top plan view of the adjustable plow assembly of the present invention wherein the plow wings are retracted and the plow is centered on a support frame, with the fluid cylinders, hinge and slide assembly shown in phantom for each of the plow wings.

Referring now to the drawings in greater detail, an adjustable wing plow assembly 10 includes a reinforced main plow 12 pivotally mounted on a support frame 14 via an intermediate support 16. Slidably mounted at opposite ends 18, 20 of main plow 12 are extendable plow wings 22, 24 which are each moved by at least one and, in certain embodiments, two actuators, such as fluid power cylinders 200, 202, 204 and 206, remotely controlled from the cab of the pickup truck, dozer, or other vehicle on which the plow assembly 10 is mounted. Wings 22, 24 are independently slidably movable between retracted positions as shown in FIGS. 1–5, fully extended positions as shown in FIGS. 14–17, and forwardly angled positions in which the plow assembly has a generally U-shaped configuration shown in FIGS. 18–22. Plow assembly 10 is primarily adapted for plowing snow when attached to the front of a transport vehicle such as a pickup truck, utility vehicle, tractor, or the like via support frame 14. However, other materials, such as sand, dirt, gravel, bark mulch, and the like, can also be moved with the plow. In addition, plow 12 can be mounted on other vehicles, such as bulldozers, graders or other construction or excavation vehicles, and in other ways besides support frame 14, such as by vertical supports secured to the rear of the plow as explained more fully below.

Preferably, both support frame 14 and intermediate support 16 are similar to the support frame and intermediate support disclosed in commonly assigned U.S. Pat. Nos. 5,638,618 and 5,899,007, which are hereby incorporated herein by reference, such that a detailed discussion of the support frame and intermediate support need not be included herein. However, plow assembly 10 may be mounted to the vehicle via any other means, such as via conventional mounting frames or supports, without affecting the scope of the present invention. Suffice it to say that, as shown in FIG. 1, support frame 14 is of the type suitable for attachment to the front of a pickup truck or the like and preferably includes a triangularly shaped, reinforced framework having a base 26, inwardly tapering sides 28, 30 leading to a forward apex 32, and spaced pairs of rearwardly extending support flanges 34, 36 on base 26 adapted to allow frame 14 to be secured to a suitable hitch assembly on the front of a pickup truck or other vehicle for pivotal movement about a horizontal axis A extending through the support flanges. Laterally extending pairs of vertically spaced cylinder support flanges 38, 40 extend outwardly from the opposite sides 28, 30 of frame 14 and the outermost support flanges 34, 36. A pair of extendable, single acting, hydraulic fluid cylinders 42, 44 are pivotally mounted, one on either side of frame 14, between cylinder support flanges 38, 40 and pivot pins 46, 48 on intermediate support 16. Pins 46, 48 extend between an upper plate 47 and a spaced lower plate (not shown) of intermediate support 16.

Intermediate support 16 (FIG. 1) is an elongated steel beam having a generally U-shaped configuration in cross section, upper plate 47, the lower plate, a forward plate (also not shown), and pairs of plow mounting flanges 50 welded to the ends of the plates and projecting forwardly toward the rear surface of plow 12. Plow 12 includes rearwardly extending, vertically oriented supports or mounting flanges 54, 56 extending between flanges 50, for mounting on horizontal rods 58, 60 aligned on a common horizontal axis B to allow the entire plow 12 to pivot about that horizontal axis. Intermediate support 16 is, in turn, pivotally mounted to apex 32 of support frame 14 by a generally vertically extending pivot pin 62.

Figure 24:
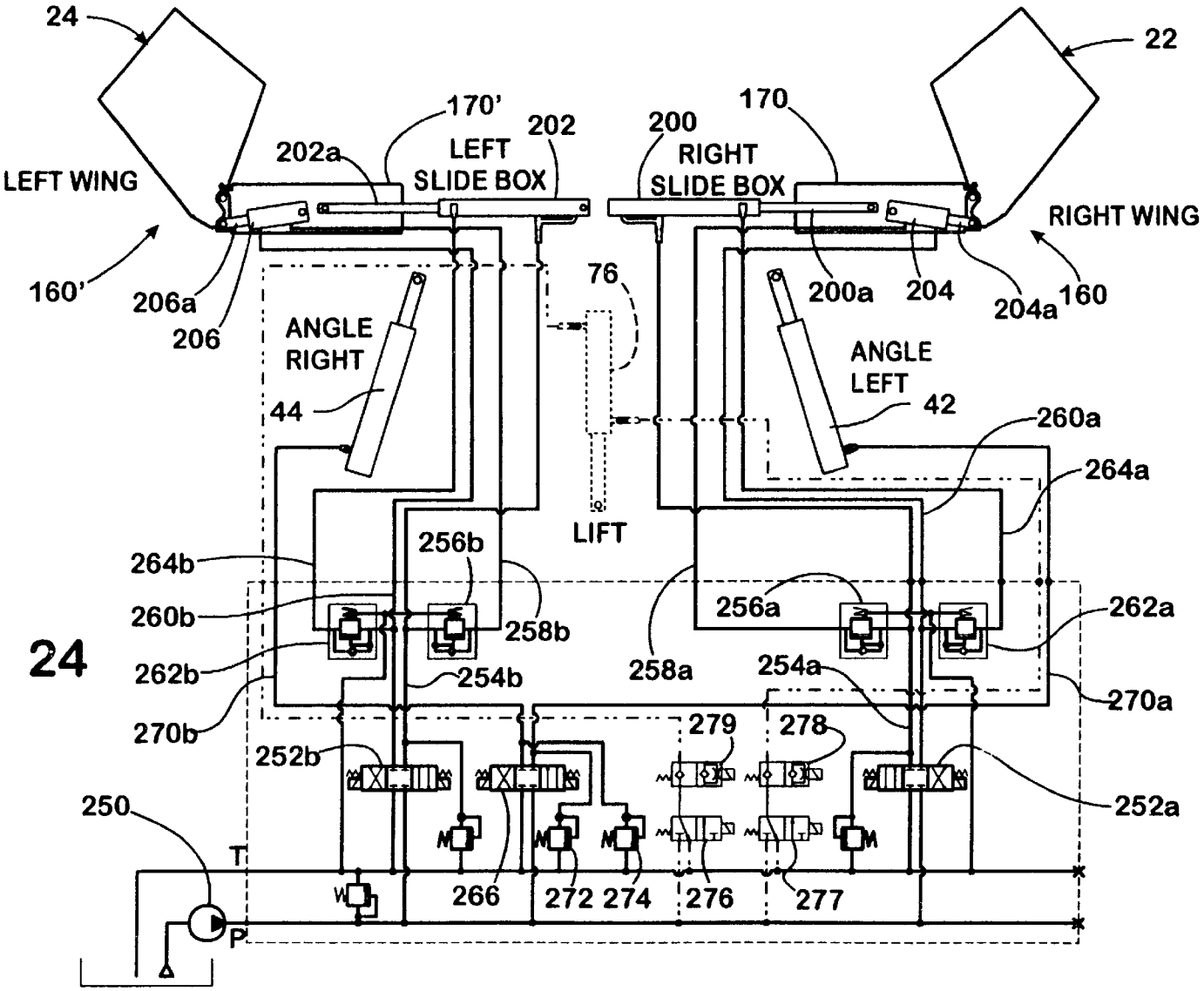
FIG. 24 is a schematic illustration of the hydraulic system for operation of the adjustable plow assembly of the present invention.

By controlling the extension and retraction of fluid cylinders 42, 44, intermediate support 16 and plow 12, which is mounted thereon, may be moved to a series of angled positions such that plow 12 is swung and angled to the left or right about pivot 62. Plow 12 is biased to an upright position about horizontal axis B on pins 58, 60 by a series of biasing members such as coil springs 64 which extend between mounting flanges 66 extending upwardly from the top surface of intermediate support 16 and support flanges 68 at the top of rear surface 84 of plow 12. In addition, a shock absorber 70 is pivotally mounted between upstanding support flanges 72 on intermediate support 16 and rearwardly extending support flanges 74 on the rear surface 84 of plow 12. Shock absorber 70 and springs 64 are shown in FIG. 1 with their middle portions cut away to reveal additional details of plow assembly 10, as discussed below. Shock absorber 70 dampens the pivotal movement of plow assembly 10 about horizontal axis B on pins 58, 60 during plowing when the plow encounters an obstacle along the surface being plowed thereby causing the plow 12 with wings 22, 24 to tip or pivot forwardly against the bias of springs 64. Rearward pivoting of the plow about axis B on pins 58, 60 is limited by the rear, vertical edges of flanges 54, 56 which engage the forward plate on intermediate support 16. Forward pivotal movement is limited by springs 64 and shock absorber 70. When support frame 14 is pivotally secured to a horizontal axis A on a vehicle via support flanges 34, 36, the entire support frame 14, intermediate support 16 and plow 12 including extendable wings 22, 24 may be lifted away from the ground or other support surface via a retractable hydraulic cylinder 76 (FIG. 24). Lift cylinder 76 is preferably pivotally mounted between the support frame 14 and a suitable mounting point on the pickup truck or other vehicle.

Figure 15:
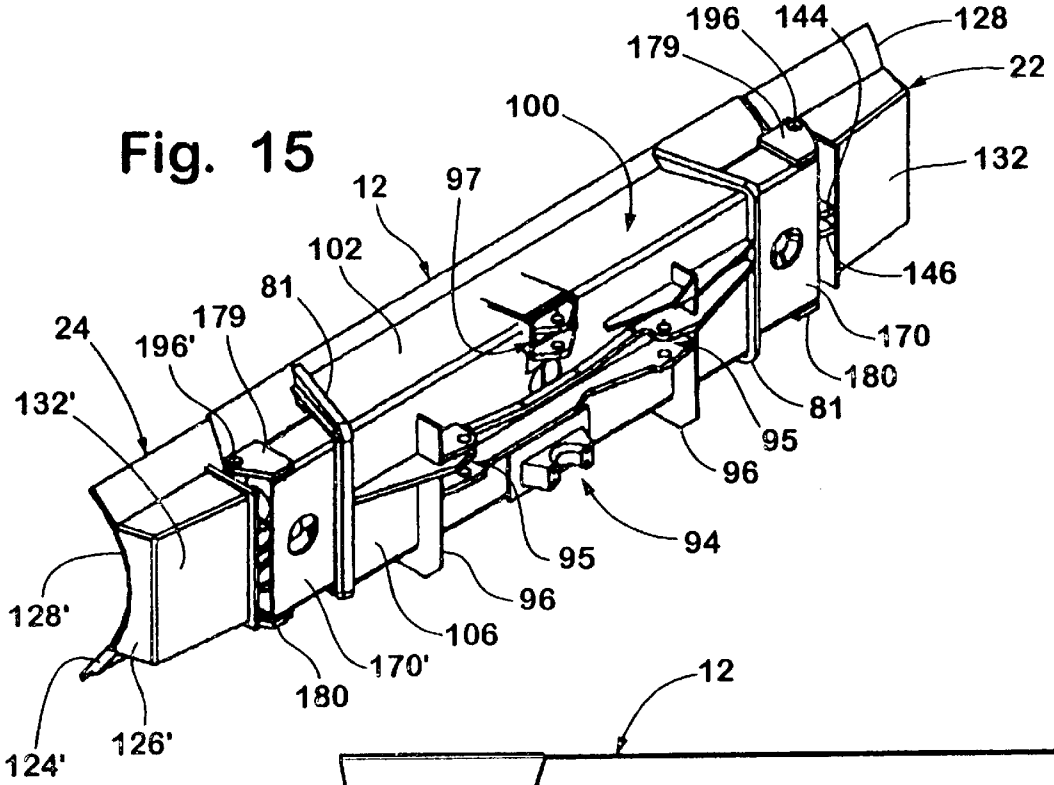
FIG. 15 is a rear perspective view of the plow assembly of FIG. 14, showing the mounting brackets for mounting the plow to a support frame at the vehicle.
Figure 16:
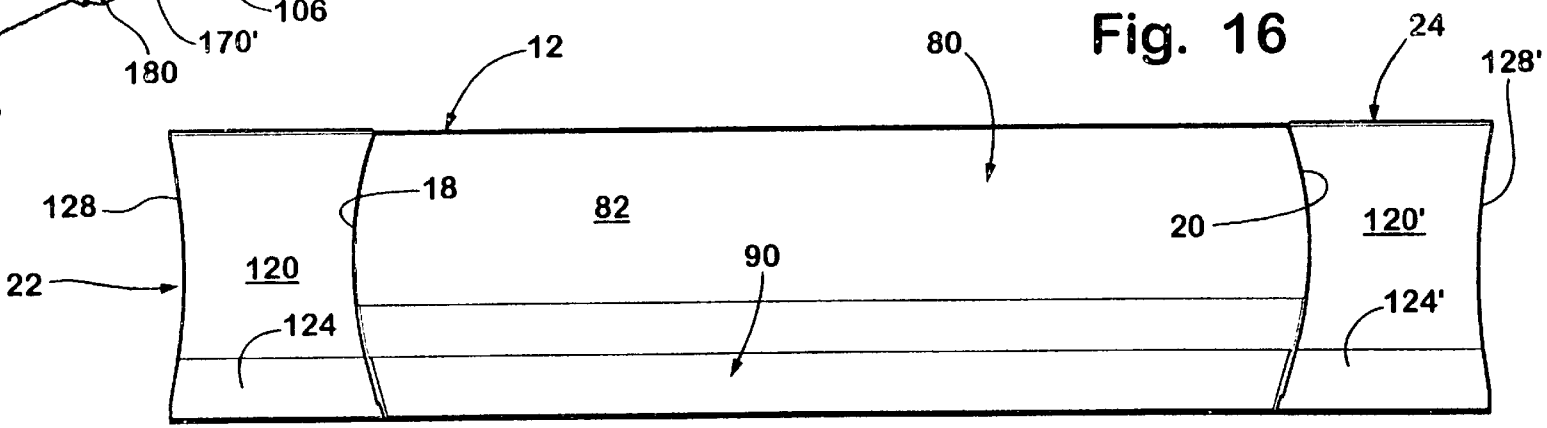
FIG. 16 is a front elevation of the plow assembly with the wings extended as shown in FIGS. 14 and 15.
Figure 18:
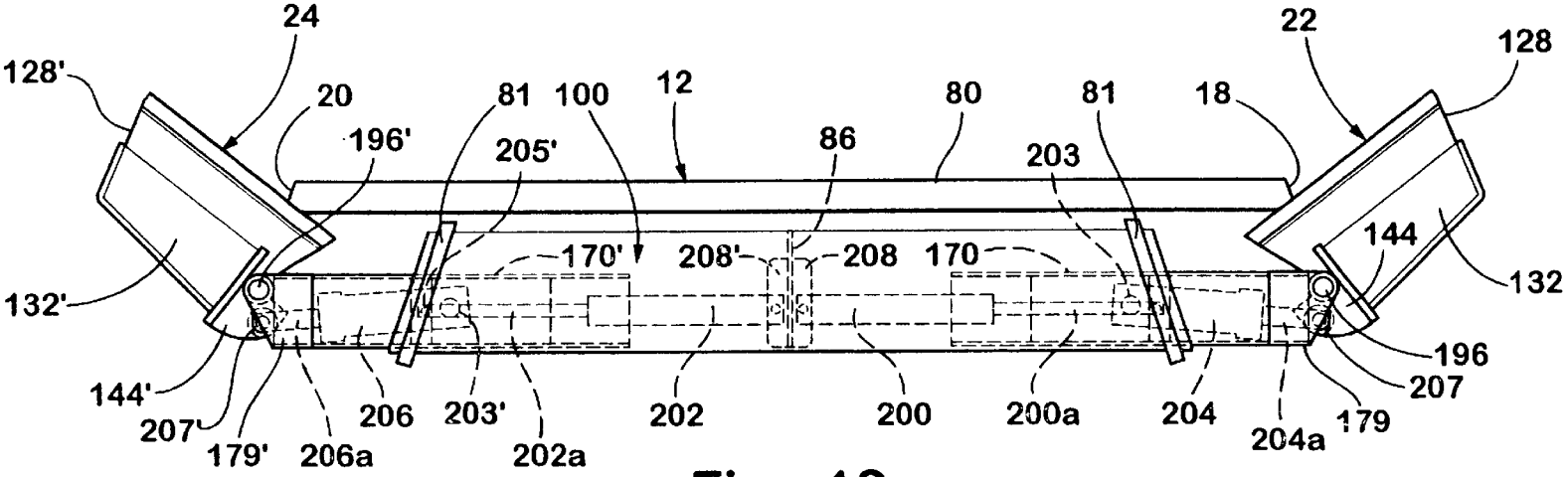
FIG. 18 is a top plan view of the plow assembly of the present invention with the plow wings extended and angled forwardly forming a generally U-shaped plow, with the fluid cylinders, hinge and slide assembly shown in phantom for each of the plow wings.
Figure 21:
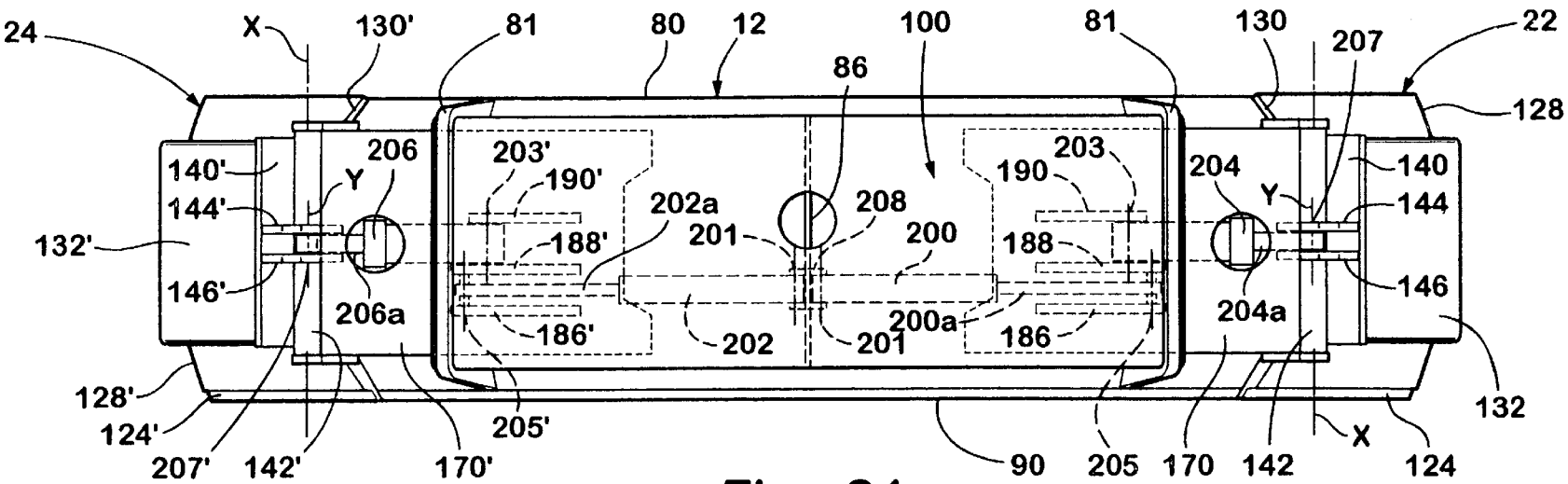
FIG. 21 is a rear elevation of the plow assembly of FIGS. 18–20, with the fluid cylinders, hinge and slide assembly shown in phantom for each of the plow wings.

Although shown as mounting to intermediate support 16, plow 12 may alternately mount directly to a support frame via the mounting brackets shown in FIG. 15. Such mounting brackets may be suitable for mounting the plow to a dozer or other excavation or construction vehicles. A central pivot bracket or collar 94 pivotally receives a pivot pin or axle (not shown) at a forward end of the support frame (also not shown). A pair of actuator mount flanges 95 are positioned at each side of central bracket 94 and pivotally mount an end of a pair of side actuators, which are operable to pivot plow 12 about the pivot pin similar to actuators 42, 44 discussed above. A pair of brackets 97 may also be mounted at the rear of plow 12 to provide attachment for a fore/aft tilt restraint linkage or the like. Such a bracket could also accommodate a side tilt actuator or cylinder (not shown). Additional plates or flanges 96 may be provided to strengthen and support plow 12. Other mounting means may be implemented, without affecting the scope of the present invention.

As best shown in FIGS. 3, 6, 7, 16 and 20, main plow 12 is preferably an elongated, rectilinear steel moldboard 80 having a concave front surface 82 and a convex rear surface 84. Secured to a lower flange which extends along the lower edge of moldboard 80 is a replaceable elongated, rectilinear plow blade 90, which may be secured to moldboard 80 by fasteners (not shown) having countersunk heads which are flush with the front surface of blade 90 to prevent interference with the material being plowed. Alternately, carriage bolts having rounded heads could be used as fasteners, or plow blade 90 may be molded or otherwise formed with moldboard 80, without affecting the scope of the present invention. Because plow wings 22, 24 are mounted along rear surface 84, moldboard 80 provides a generally continuous, uninterrupted front surface 82, such that the material being moved by the plow moves upwardly along moldboard 80 from plow blade 90 and continues along front surface 82 of the moldboard without interruption. The right and left ends of moldboard 80 are curved (FIG. 3) so as to align with the front surface of wings 22, 24 when the plow wings 22, 24 are extended outwardly and angled forwardly as shown, for example, in FIGS. 18–22. The rear surface 84 of moldboard 80 is preferably reinforced with supports or mounting flanges (not shown) on either side of its center, as well as end flanges 81 welded to rear surface 84 adjacent either end.

Moldboard 80 is preferably formed of steel or other strong, durable material. However, it is envisioned that the rectilinear moldboard 80 may alternately be formed in two sections, similar to the moldboard disclosed in U.S. Pat. No. 5,899,007. For example, moldboard 80 may include a first, steel section which extends up from the top of plow blade 90, and a second, upper, curved section of the moldboard, which is preferably formed from a polymeric sheet material such as opaque ultra high molecular weight (UHMW) polyethylene or clear polycarbonate. Accordingly, when material to be plowed, such as snow, sand, dirt, gravel or other plowable material, engages the plow blade 90, it is forced upwardly along the first moldboard section, which bears the principal amount of force causing the material to change directions, while the remainder of the first section and the second section impart a rolling action or a continuation of the change in direction to force the plowed material forwardly as the plow is moved in the same direction. Such a polymeric sheet material may save a significant amount of weight in the overall plow assembly, and also may provide the ability to view through the upper section of the plow, especially when the plow assembly is raised to its inoperative position when mounted on the front of a truck. However, moldboard 80 may be unitarily formed of steel or polymeric materials, and may be formed with the plow blade, without affecting the scope of the present invention. In addition, support skids (not shown) may be mounted at either end of the rear of the main plow assembly.

On the rear surface 84 of moldboard 80 is preferably welded a rectangular, steel slide support or housing 100 having a top wall 102, bottom wall 104, and rear wall 106 forming a generally U-shaped enclosure. End flanges 81 define a partial outer wall of housing 100 and provide an opening therethrough. As will be explained below, slide support or housing 100 is adapted to receive a generally rectangular inner slide member 170, 170', best seen in FIGS. 8–13. Alternately, the actuators, slides, hinges and wings may be mounted along the rear surface 84 of moldboard 80 within an open frame or structure or along support rails or the like positioned along the rear of the plow, such that the slides and wings are otherwise movably mounted along the rear of the plow, without affecting the scope of the present invention. Mounting flanges 54, 56 and the plow reinforcing flanges may extend over top wall 102, along rear wall 106 and thereafter along bottom wall 104 of housing 100 and are welded thereto to reinforce the entire assembly. However, FIGS. 2–14 and 16–23 are shown with the mounting and reinforcing flanges removed to assist in clarifying the details of the present invention.

Within housing 100, a center support plate or flange 86 is welded to rear surface 84 of moldboard 80 and/or to walls 102, 104 and/or 106 of housing 100 (FIGS. 4, 14, 17, 18 and 21). A pair of actuator mounting flanges 208, 210 and 208', 210' are welded to center plate 86 and extend laterally outwardly from both sides of plate 86. Flanges 208, 210 and 208, 210' provide a corresponding pair of vertically spaced apertures 201 and 201' for mounting actuators 200, 202 to plow 12, as discussed below. Flanges 208, 210 and 208', 210' may also or alternately be welded or otherwise secured to housing 100 and/or rear surface 84 of moldboard 80, without affecting the scope of the present invention.

As is best seen in FIGS. 2, 3, 12, 13, 15–17, 20 and 21, each plow wing extension 22, 24 is a substantial mirror image of the other. Because the plow wings are substantially identical, only one will be described in detail herein, namely, plow wing 22. Substantially the same elements are included in plow wing extension 24 but are shown with prime numerals.

Figure 5:
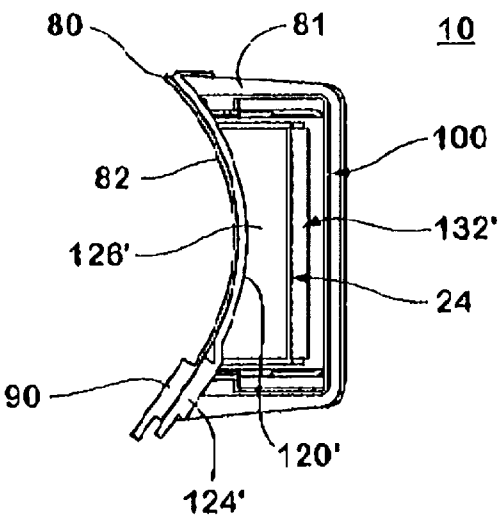
FIG. 5 is an end elevation of the plow assembly of FIGS. 1–4.
Figure 2:
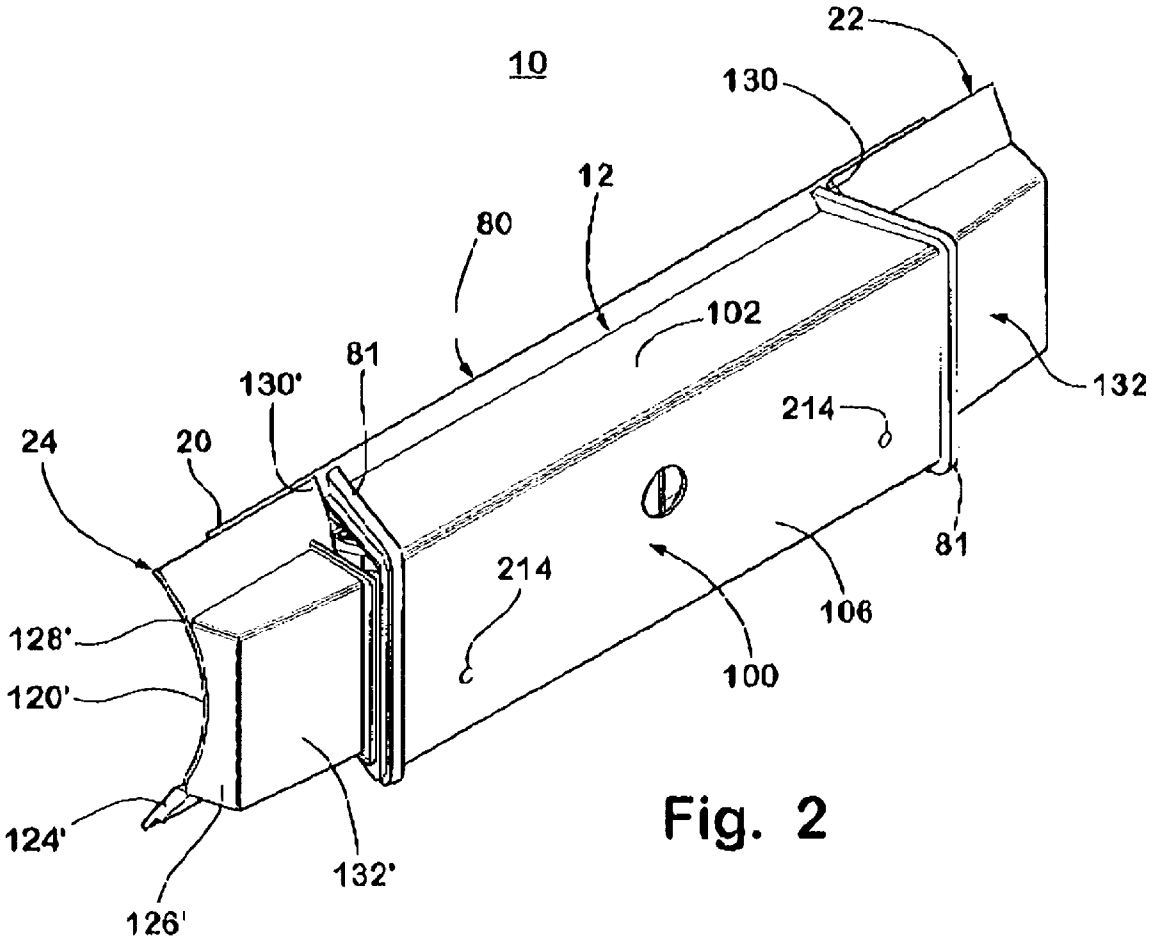
FIG. 2 is a rear perspective view of the plow assembly of FIG. 1.
Figure 3:
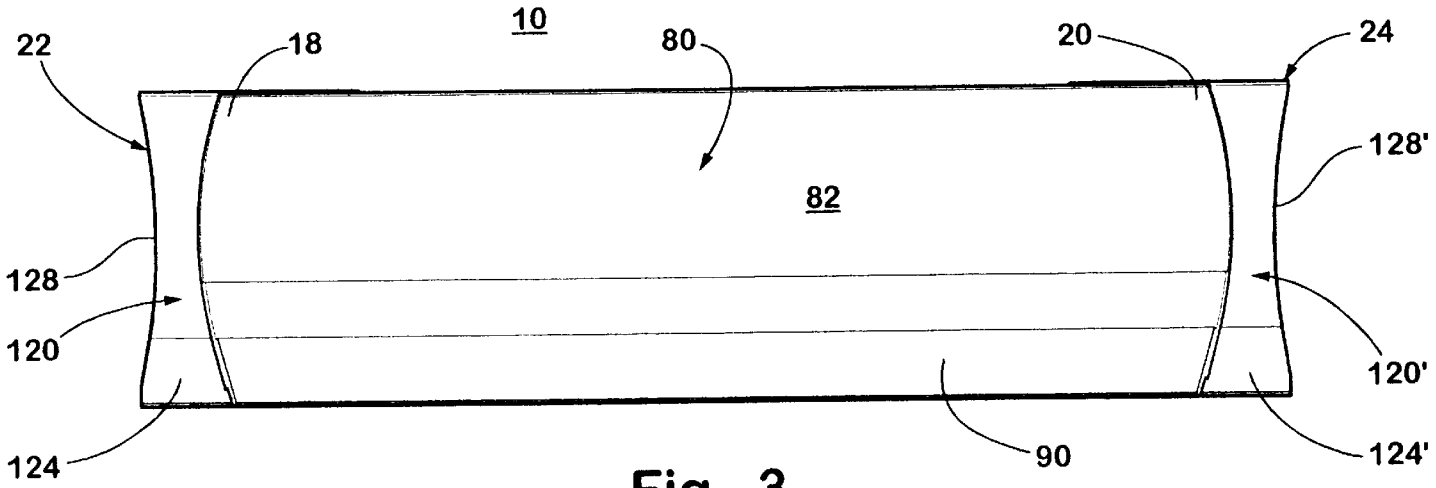
FIG. 3 is a front elevation of the plow assembly of FIGS. 1 and 2.

Plow wing extension 22 includes a moldboard section 120 having a radius of curvature substantially the same as that for moldboard 80 and extending generally parallel to moldboard 80 when mounted on the plow assembly. A steel extension blade 124, also known as a cutting edge or wear edge, is removably secured to the front surface of the lower edge of moldboard 120 and extends generally parallel to plow blade 90, as shown in FIG. 5. Blade 124 may be secured to moldboard 120 via any known means, such as via fasteners or the like, and may be formed as part of moldboard 120, without affecting the scope of the present invention. Blade 124 engages the plowed surface during plowing and may be repaired or replaced when worn. A generally vertical reinforcing wall or flange 126 extends along the outermost edge 128 of wing extension moldboard 120. The innermost edge 130 of moldboard 120 is generally curved outwardly, as best shown in FIG. 13.

Extending parallel to the upper and lower edges of wing extension 22 on the rear surface thereof is a tapered housing 132 which may have a series of weight reducing, generally rectangular openings (not shown) formed therethrough. Housing 132 is preferably formed from sheet steel bent into a generally U-shaped configuration and welded to the rear surface of moldboard 120. Housing 132 is slightly smaller than both outer housing 100 and inner slide member 170, as will be understood from FIG. 19. Housings 132, 132' preferably extend only along a portion of the rear of their respective moldboards, such that a substantial area of the rear surfaces of moldboards 120, 120', and thus the rear wing structure, are exposed. This provides improved visibility of the blade cutting edges of the wings as they contact the ground, thereby providing improved control of the quality of the finished grade to the operator of the plow.

Figure 12:
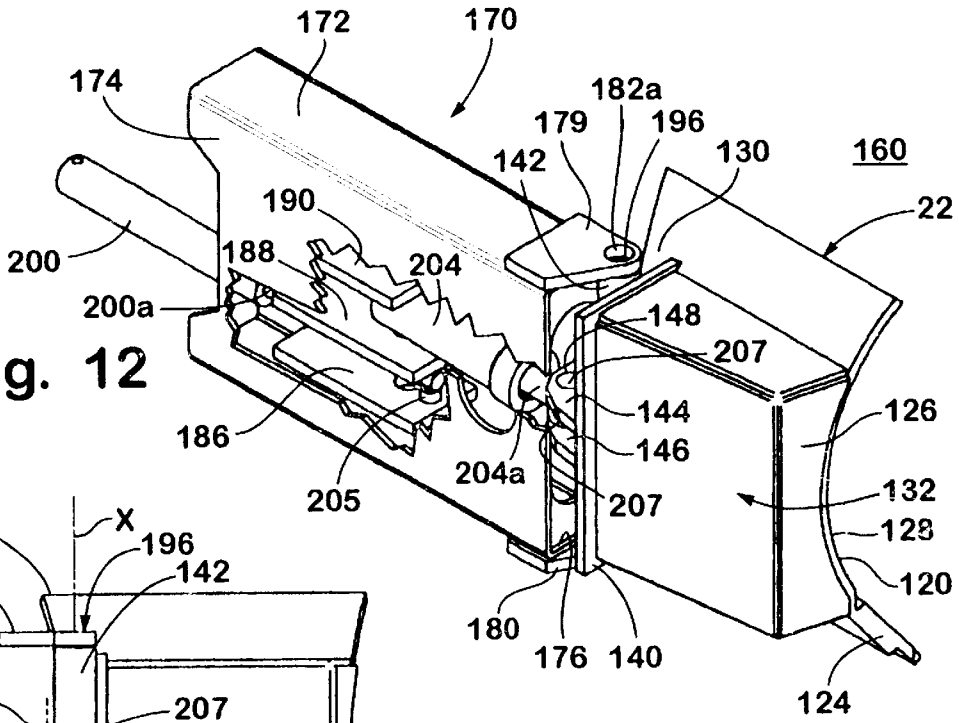
FIG. 12 is a perspective view of the slide member and plow wing of the present invention, with portions of the slide member cut away to show additional details.
Figure 13:
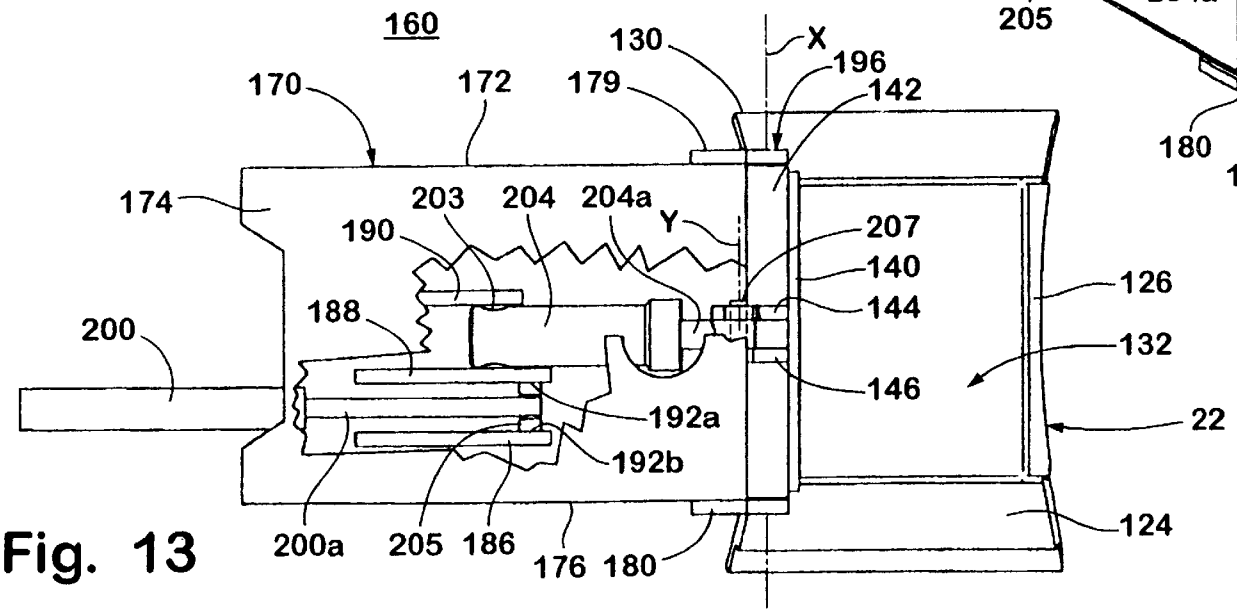
FIG. 13 is a rear elevation of the slide member and plow wing of FIG. 12.
Figure 14:
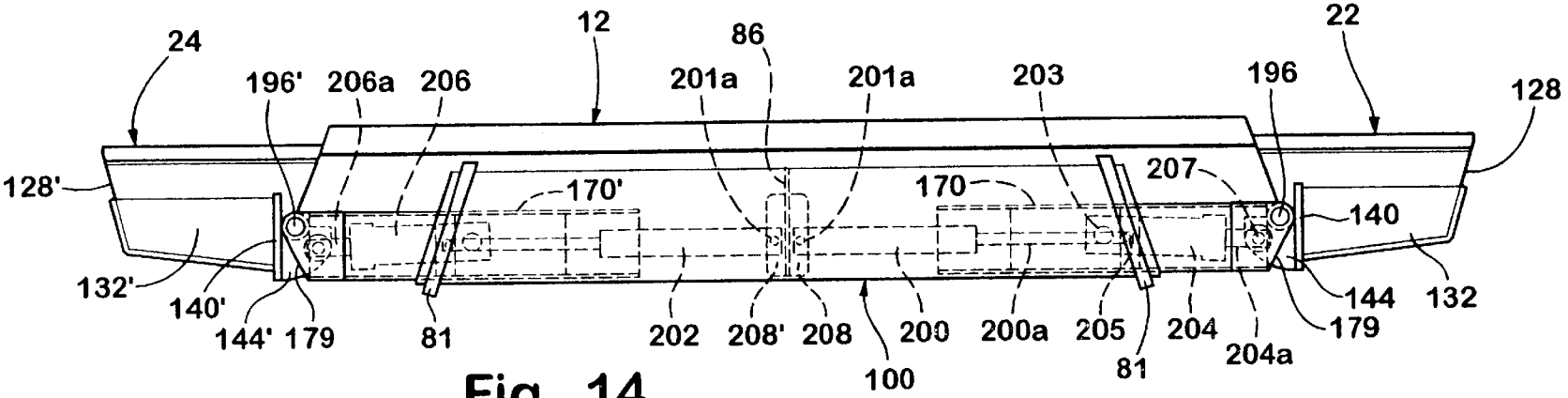
FIG. 14 is a top plan view of the plow assembly of the present invention with the plow wings extended, with the fluid cylinders, hinge and slide assembly shown in phantom for each of the plow wings.
Figures 19, 22:
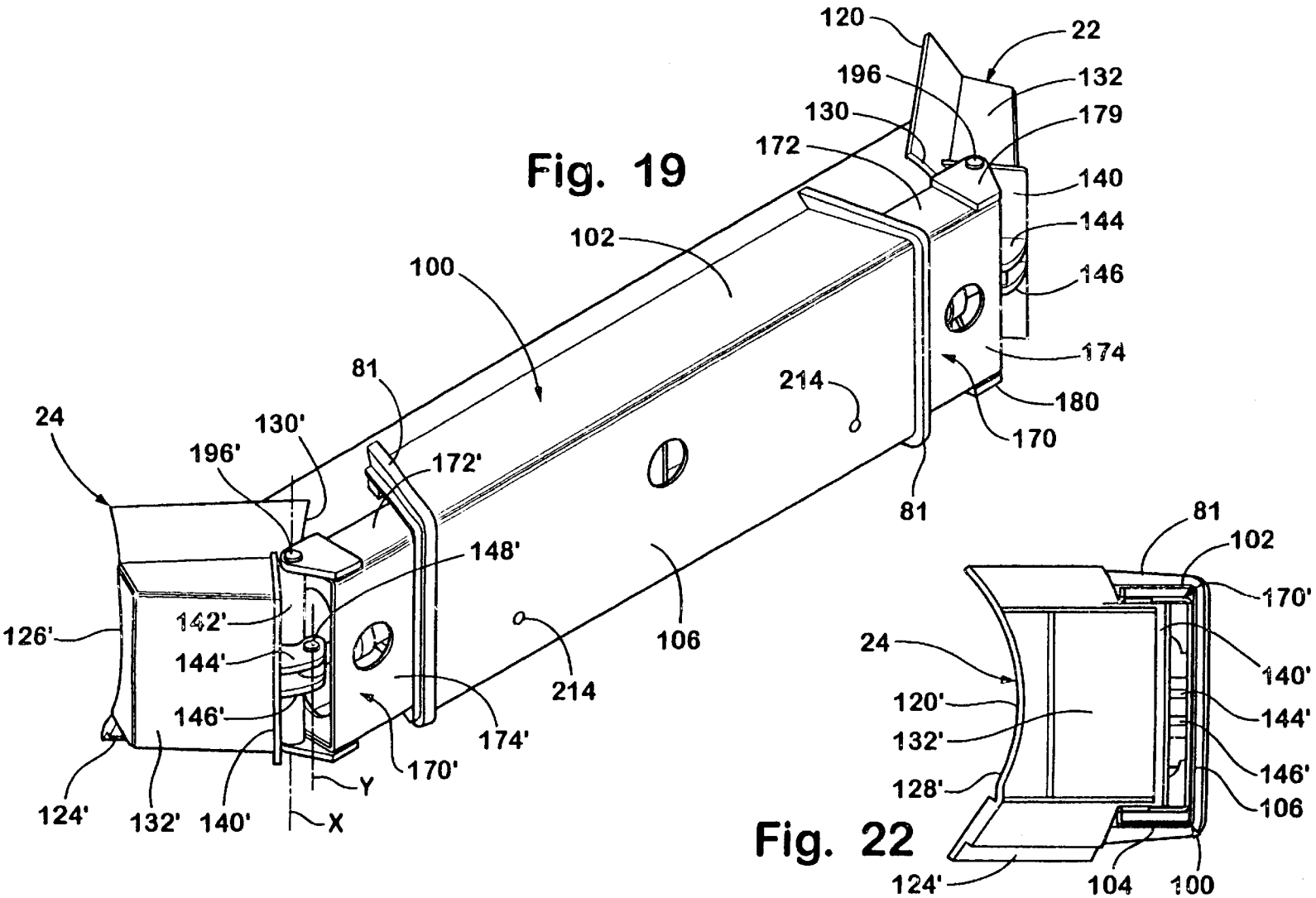
FIG. 19 is a rear perspective view of the plow assembly with the wings extended and angled forwardly as shown in FIG. 18.
FIG. 22 is an end elevation of the plow assembly of FIGS. 18–21.

With reference to FIGS. 12, 13 and 19, a vertical support plate 140 is welded to the edges of the housing 132 at the inner edge of plow wing 22. At the forward edge of support plate 140 adjacent the inner edge 130 of moldboard 120, is a vertically oriented hinge support tube or hinge cylinder 142 welded to plate 140. Intermediate the ends of support tube 142 are a pair of spaced hinge plates 144, 146 which are welded to both support tube 142 and support plate 140 and extend parallel to one another outwardly away from the inner edge of the wing extension. As shown in FIGS. 12 and 13, a vertical hinge pivot axis X is provided by support tube 142 while a fluid cylinder pivot axis Y is provided by aligned apertures 148 extending through hinge plates 144, 146. Hinge pivot axis X is offset from fluid cylinder pivot axis Y by a predetermined distance creating a moment arm providing torque for pivoting the wing extension on its hinge axis X, as will be explained more fully below.

With reference to FIGS. 12, 13, 19 and 21, each plow wing extension 22, 24 is pivotally mounted to the end of a generally rectangular slide member 170, 170', only one of which is described in detail herein. The subassemblies 160, 160' of slide member 170 and wing extension 22, or slide member 170' and wing extension 24 (FIGS. 8–13), are both adapted to be slidably mounted telescopingly within housing 100 on the rear surface of main plow moldboard 80 to allow extension, retraction and forward angling of the plow wing extensions 22, 24 by actuators 200, 202, 204 and 206, as referenced above and as explained more fully below.

As shown in FIGS. 8–13, each slide member 170, 170' is an elongated beam or frame having a generally rectangular cross section, preferably formed from welded steel, and including a top wall 172, rear wall 174, bottom wall 176, and a front wall 178. Rear walls 174, 174' may include elongated, closed slots 212 (FIGS. 6 and 8) which are adapted to receive a cylindrical stop pins 214 (FIGS. 2 and 19) projecting from housing 100, which limit the extension and retraction of the slide members, and thus, wing extensions 22, 24, as explained below. A pair of parallel hinge plates 179, 180 are welded to the top and bottom walls 172, 176, respectively, of slide member 170. Hinge plates 179, 180 project outwardly from the outer end of slide member 170, and provide vertically spaced, vertically aligned apertures 182*a* and 182*b* in the projecting portion of the hinge plates. Within slide member 170, three actuator support plates 186, 188, 190 are secured between forward wall and rear wall of slide members 170, 170'. Support plates 186, 188, 190 include two pair of vertically aligned apertures 192*a, b* and 194*a, b* which receive pivot pins for mounting the outer end and inner end of the pair of actuators or fluid cylinders for operating the wing extensions, as will be more fully explained below.

As best shown in FIGS. 12 and 13, plow wing extensions 22, 24 are pivotally mounted to the outer ends of elongated slide members 170, 170', by means of hinge plates 179, 180. As shown in FIGS. 10, 12, 13 and 19, a hinge pin 196 extends through vertically aligned apertures 182*a*, 182*b* and through cylindrical hinge tube 142 along axis X to provide the hinged movement. Plow wing 22 therefore pivots on axis X from a position in which moldboard 120 is generally rectilinearly aligned with slide member 170 to a forwardly angled position in which moldboard 120 extends at an obtuse angle to slide member 170 (FIG. 19). In addition, slide member 170 or housing 100 may include elongated, synthetic wear pads or strips 108 (FIG. 6) secured to the outer surface of one or more walls of slide member 170 or to the inner surface of one or more walls of housing 100 to slidably support slide member 170 inside housing 100 and to maintain the slide members in alignment with the rear surface of 84 of moldboard 80. Preferably, wear pads 108 are formed from ultra high molecular weight (UHMW) polyethylene, although other materials, such as Teflon, steel and the like could also be used. As shown in FIGS. 6 and 8–10, however, one or more of the walls of slide member 170 may engage the inner surface of housing 100 to slidingly support the slide member 170 within the housing. Optionally, suitable lubricants may also be used to enhance sliding of the slide member along the slide support or housing.

Figure 4:
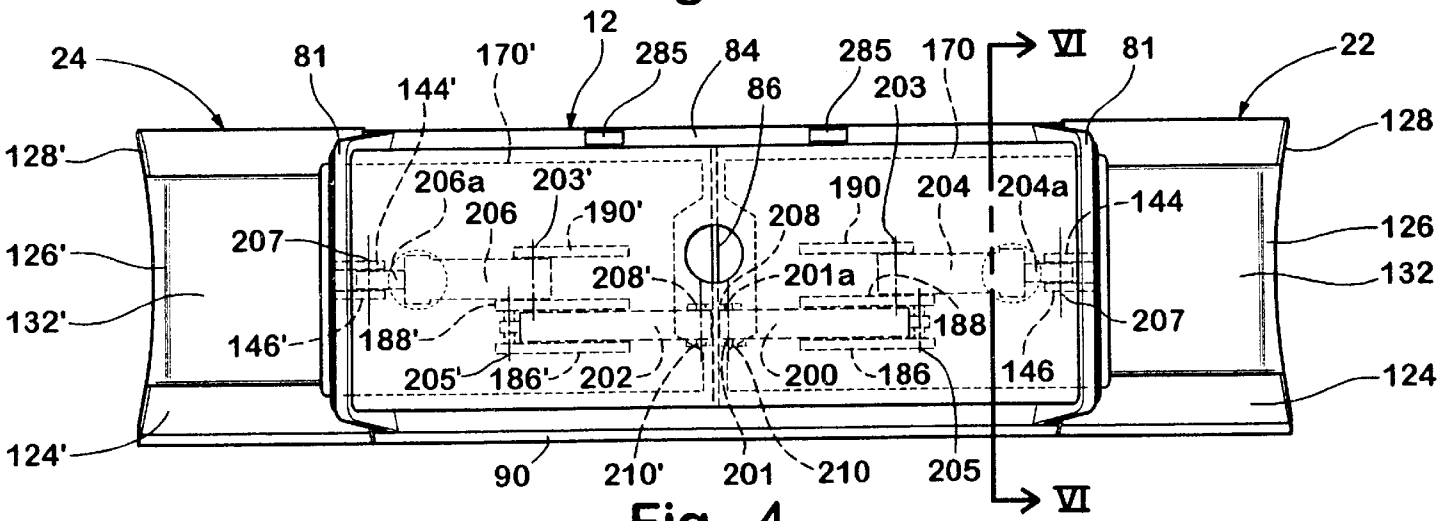
FIG. 4 is a rear elevation of the plow assembly of FIGS. 1–3, with the fluid cylinders, hinge and slide assembly shown in phantom for each of the plow wings.
Figure 7:
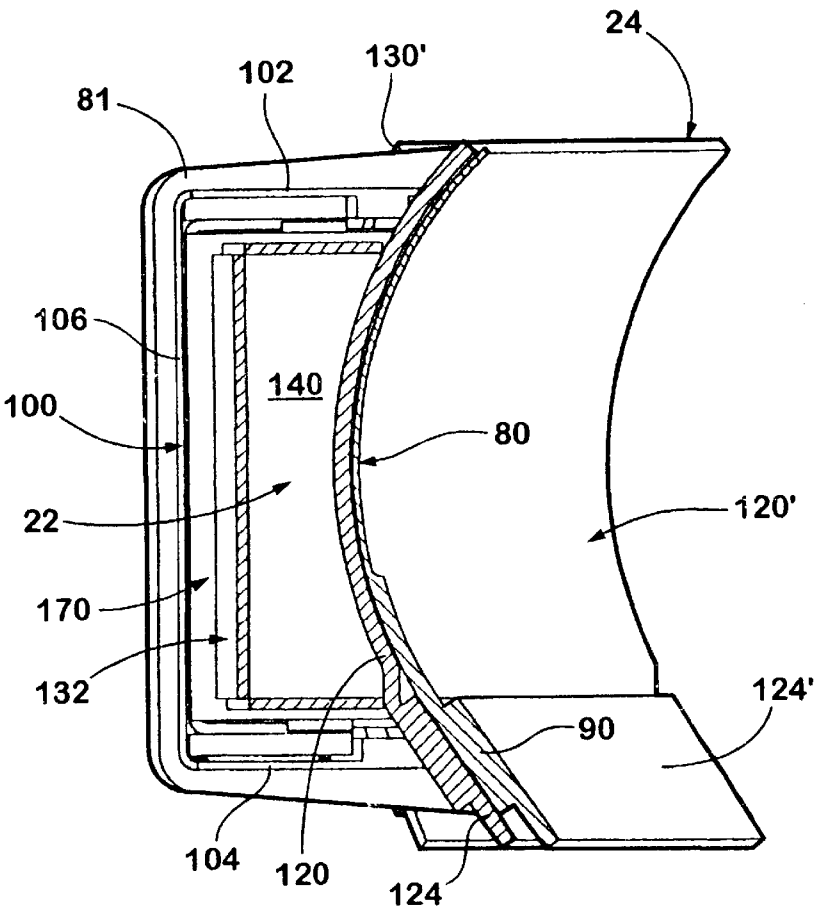
FIG. 7 is a cross sectional view taken along the line VII—VII in FIG. 23.
Figure 6:
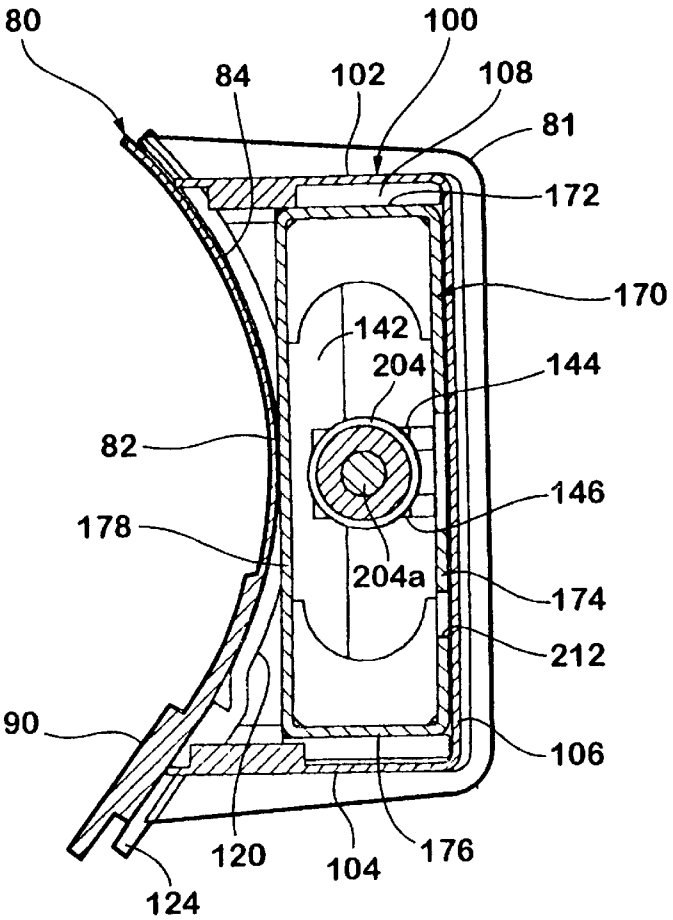
FIG. 6 is a cross sectional view taken along the line VI—VI in FIG. 4.
Figure 11:
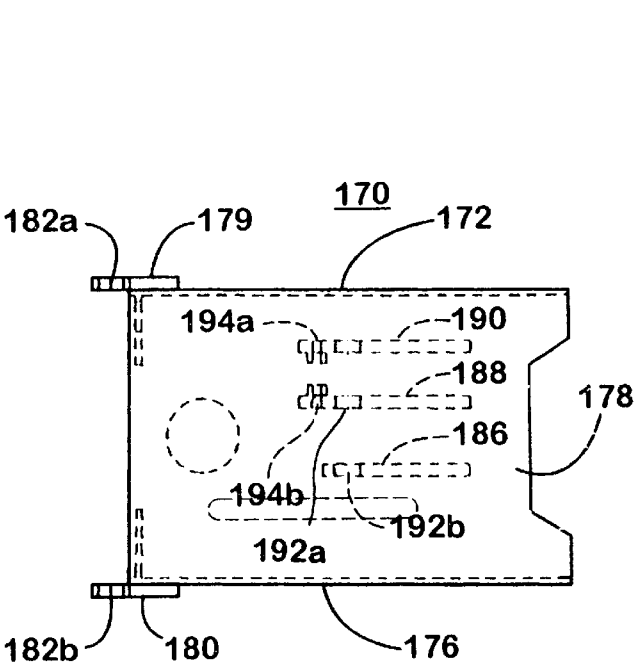
FIG. 11 is a front elevation of the slide member of FIGS. 8–10.
Figure 9:
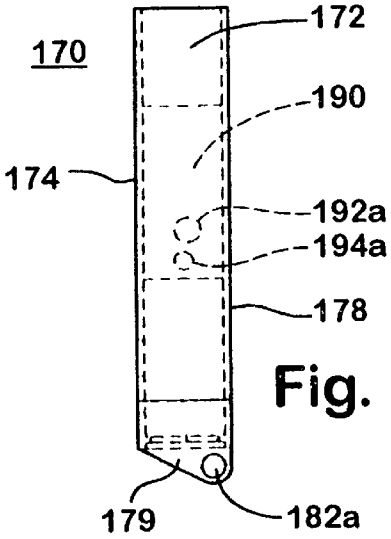
FIG. 9 is a top plan view of the slide member of FIG. 8.
Figure 10:
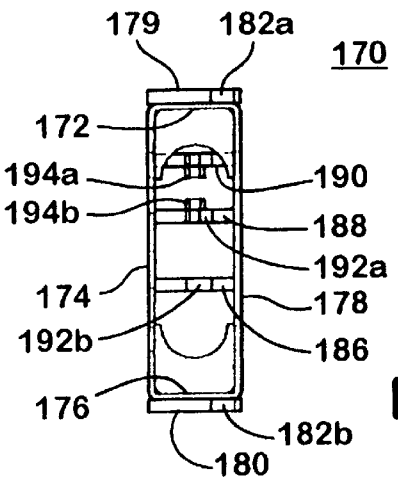
FIG. 10 is an end elevation of the slide member of FIGS. 8 and 9.
Figure 8:
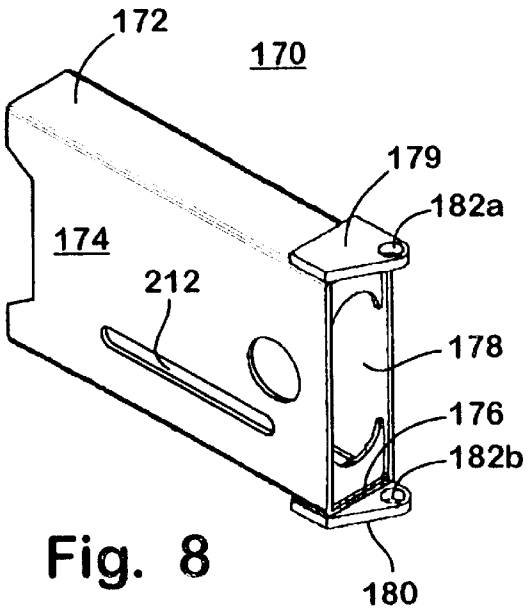
FIG. 8 is a perspective view of a slide member useful with the present invention.
Figure 17:
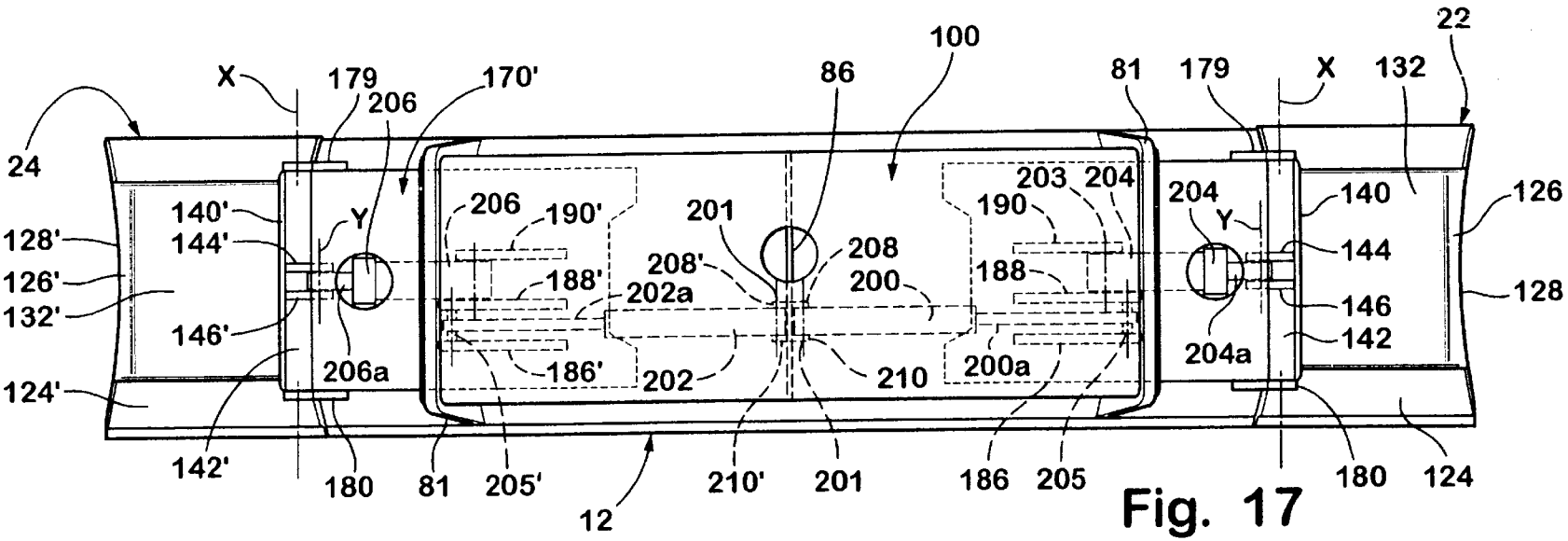
FIG. 17 is a rear elevation of the plow assembly of FIGS. 14–16, with the fluid cylinders, hinge and slide assembly shown in phantom for each of the plow wings.

With reference to FIGS. 4, 6 and 17, it will now be understood that the subassemblies 160, 160' of slide members 170, 170' and their pivotally attached plow wing extensions 22, 24, respectively, are telescopingly mounted within the interior of the slide support or outer housing 100 for sliding rectilinear movement within the outer housing along a common axis. Optionally, the slide members may slide along one or more wear pads 108 within housing 100. Alternately, however, the slide members, actuators and wings may be mounted along the rear of the plow via other slide support means, such as an open frame or upper and lower support rails or the like, without affecting the scope of the present invention. Such a mounting scheme facilitates easier access to the actuators, since they are not substantially encased within a housing. Wings 22, 24 are extended and pivoted via actuators 200, 202 and 204, 206, respectively. Actuators or fluid cylinders 200, 202 include extendable members 200*a*, 202*a*, such as piston rods or the like, while actuators 204, 206 include extendable members or rods

204*a*, 206*a*. Actuators 200, 202 are longer and extend rods 200*a*, 202*a* a greater distance than actuators 204, 206 and rods 204*a*, 206*a*. As shown in FIGS. 1, 4, 14, 17, 18 and 21, actuators 200, 202 extend into the interior space of slide members 170, 171' from their inner end, while fluid cylinders 204, 206 are mounted within the interior space of slide members 170, 170' and extend out of the outer end of the slide members for engagement with the plow wings.

Movement of each slide member 170, 170' is accomplished by a power source or actuator 200, 202, preferably a pair of independent, overlapping, double acting, hydraulic fluid cylinders. The nonextendable ends of actuators 200, 202 are pivotally mounted between the pair of support plates 208, 210 and 208', 210' via pivot pins 201*a* (FIGS. 18 and 21), such that actuators 200, 202 are generally aligned with one another along the rear surface of the plow and within housing 100. An aperture (not shown) may be provided through rear wall 106 of housing 100 adjacent to plates 208, 210 and 208', 210' for access to the actuators. The outer ends of extendable piston rods 200*a*, 202*a* are pivotally secured to slide member 170, 170' by pivot pins 205 mounted through vertically aligned apertures 192*a*, 192*b* or 192*a*', 192*b*' of support plates 188, 186 or 188', 186', respectively. Although two double acting, hydraulic fluid cylinders are shown for use in slidably moving the slide members along the plow, it is within the scope of the invention to utilize other power sources to extend or retract the plow wings, such as a single actuator for each wing, whereby extension of the actuator first extends the wing to the extended position and further extension of the actuator pivots the wings toward the forwardly angled position. It is further envisioned that both of the plow wings may be movable via a single, double acting hydraulic cylinder which has extendable rods projecting from either end, or by other means for extending or retracting the wings with respect to the plow. Other extendable means may be implemented, such as, for example, threaded rods rotated by at least one electric motor or a pulley and cable system, to move slides 170, 170' outwardly or inwardly for extension and retraction, without affecting the scope of the present invention.

Likewise, actuators or fluid cylinders 204, 206 are respectively pivotally connected to slide member 170, 170' via pivot pins 203 passed through vertically aligned apertures 194*a*, 194*b* or 194*a*', 194*b*' of support plates 190, 188 or 190', 188', and through the end of the fluid cylinders. The outer ends of extendable piston rods 204*a*, 206*a* are pivotally connected via hinge pins 207 passed through the vertically aligned apertures 148, thereby defining axis Y in hinge plates 144, 146 or 144', 146'. Because of the offset between pivot axes X and Y, when fluid cylinder rods 204*a*, 206*a* are extended from cylinders 204, 206, the moment arm of the offset created by the positioning of the cylinder rods rotates plow wings 22, 24 forwardly about hinge pins 196, 196'. Fluid cylinders 204, 206 act to hold and restrain the wing extensions 22, 24 in the position in which they are located.

When extension of either wing 22 and/or 24 is desired, the respective fluid cylinder 200 and/or 202 is activated by means of a hydraulic control system, described more fully below, to extend piston rod 200*a*, 202*a*, thereby moving slide member 170 or 170' rectilinearly outwardly along with wings 22 or 24, and preferably on wear pads 108. Fluid cylinders 200, 202 move slide members 170, 170' outwardly to their full extension while moldboard 120 remains substantially parallel to the front surface of main plow 12. Sliding movement of slide member 170, 170' may be limited by the projecting, cylindrical stop members 214 which are mounted at housing 100 and are in alignment with the corresponding slots 212 in the slide members. Optionally, the hydraulic cylinders 200, 202 may provide a positive stop of their extension and retraction at their full extension or retraction, whereby the pistons may "bottom out" within the cylinder to limit extension/retraction of the piston and rod assembly at a desired position. Extension of slide member 170, 170' thus continues until a switch is thrown to stop extension of actuator 200, 202 or until the stops engage the inner ends of the slots, or is otherwise stopped, thereby stopping further outward extension of the plow wings. Clearly, other means for limiting outer movement of the slide members relative to plow 12 may be implemented, without affecting the scope of the present invention. In the extended positions, as shown in FIGS. 14–17, the outer wing ends 128, 128' are spaced outwardly of the retracted position and of the outer ends 18, 20 of main plow moldboard 80.

Figure 20:
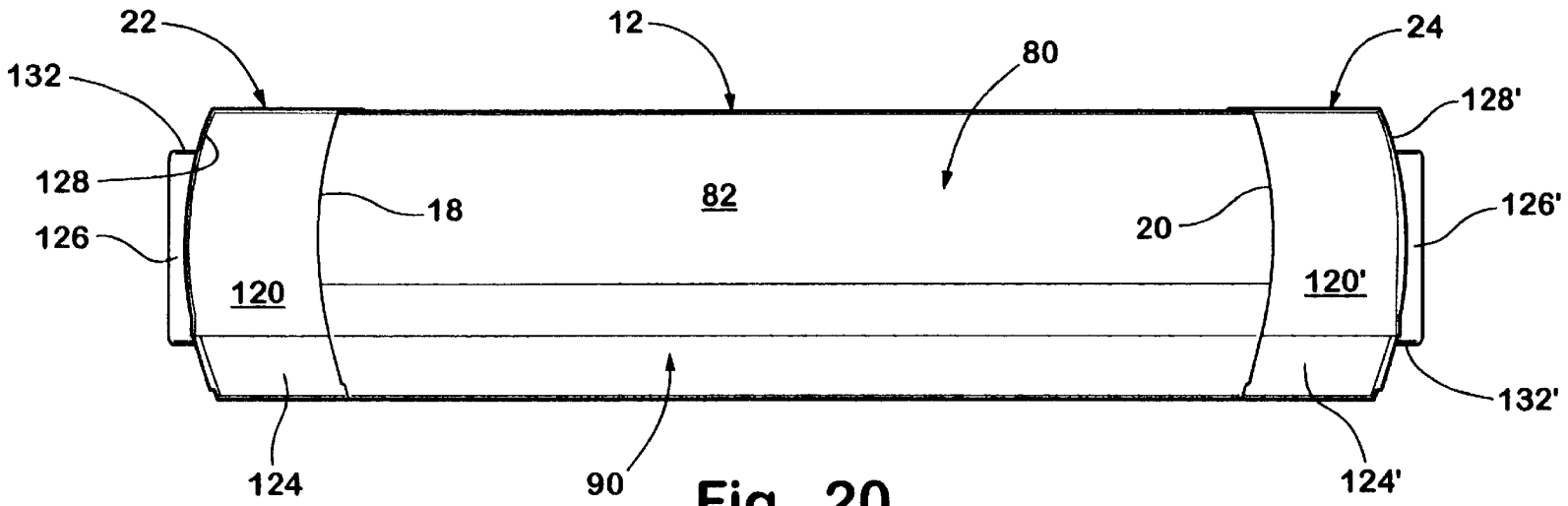
FIG. 20 is a front elevation of the plow assembly of FIGS. 18 and 19.

In the event it is desired to pivot one or both of the wings 22, 24 forwardly, one of the actuators 204, 206, or both actuators, are activated to pivot the wings about pivot pins 196, 196' until the wings are angled forwardly at an obtuse angle to the main plow moldboard, as shown in FIGS. 18–23, such that the entire plow may have a U-shaped configuration (if both wings are pivoted forwardly as shown in FIGS. 18–22). Extension of pivotally mounted fluid cylinders 204, 206 causes rotation of wing extensions 22, 24 forwardly about hinge pins 196, 196' due to the distance between pivot axes X and Y, as shown in FIGS. 13, 17 and 19. As best seen in FIG. 20, in such a position, ends 18, 20 of main plow moldboard 80 are curved to substantially engage the forward surface of partial moldboard 120 of plow wings 22, 24 along an inward end thereof. The outward curved edges 18, 20 of moldboard 80 allows the plow wings to be pivoted to the forward position without interference between those edges and the plow wings. Additionally, edges 130, 130' of wings 22, 24 are curved inwardly to avoid interference with the actuators, housings and slide members as the wings are pivoted toward their forwardly angled positions. Hydraulic pressure within cylinders 204, 206 keeps the plow wings in the forwardly pivoted positions for pushing or carrying snow or other plowable material such that the material does not slip off the ends of the plow assembly.

Likewise, when fluid cylinders 204, 206 are retracted, the opposite motions occur. As the extendable members or rods 204*a*, 206*a* are retracted, plow wings 22, 24 are pivoted rearwardly into alignment with main plow moldboard 80 about pivot pins 196, 196'. When housings 132, 132' are aligned with slide members 170, 170' (as shown in FIGS. 12–17), retraction of the actuators or fluid cylinders 200, 202 causes the plow wings 22, 24 to move along the rear surface of the main plow moldboard to the retracted positions shown in FIGS. 1–5. Inward movement of the slide members 170, 170' may be limited, such as by the stop members 214 engaging the outer ends of the slots 212 and thereby preventing further inward sliding movement of the slide members.

As explained below, the plow operator may simply operate a single switch to extend one or both of fluid cylinders 200, 202 after which the fluid pressure is automatically transferred to the second fluid cylinder or cylinders 204, 206, respectively, such that the slide member is fully extended and the wing extensions are then pivoted forwardly all in a continuous movement or motion. The hydraulic pressure in the fluid cylinders resists rearward pivoting of the forwardly angled wing extensions during plowing. In the event an obstacle is encountered, extreme pressure created within the fluid cylinders 204, 206 would be relieved through the hydraulic system to prevent rupture of hydraulic lines or damage to any of the components.

Figure 23:
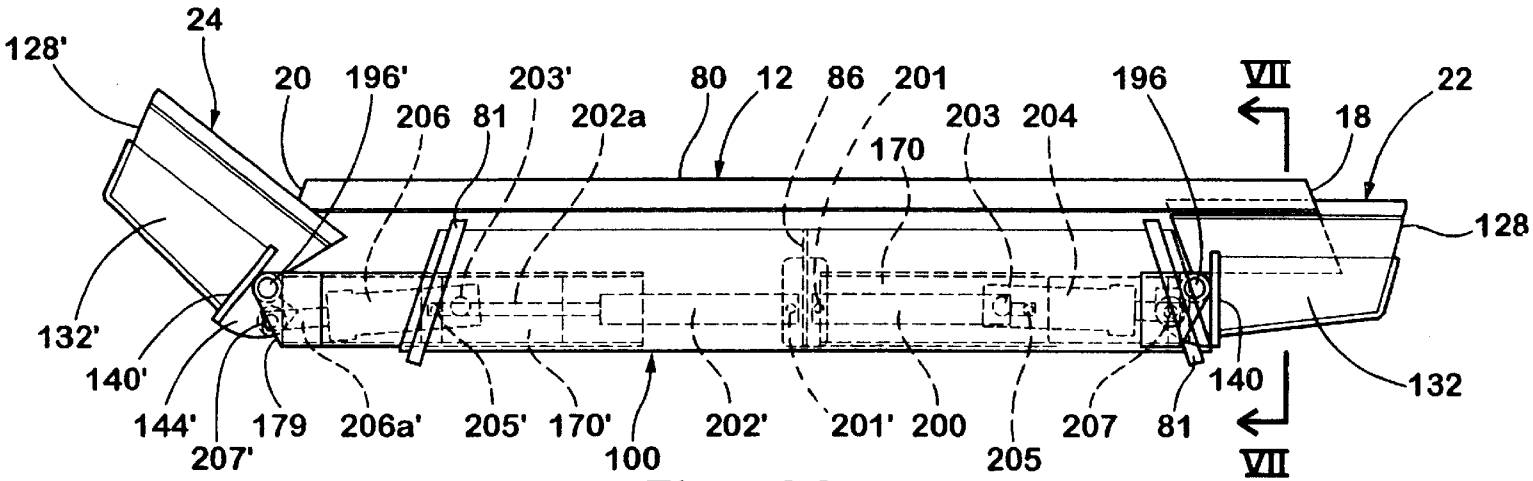
FIG. 23 is a top plan view of the plow assembly of the present invention with one of the plow wings extended and angled forwardly and the other plow wing in the retracted position, with the fluid cylinders, hinge and slide assembly shown in phantom for each of the plow wings.

Thus, the plow assembly may be used in its retracted position to plow snow or other plowable materials when either centered or angled to the left or right, the preferred length of such plow in the retracted position being approximately eight feet. Secondly, cylinders 200, 202 can be extended simultaneously or independently of one another such that wing extensions 22, 24 are in their fully extended positions as shown in FIGS. 14–17 and the plow may also be used either centered or angled left or right by extending one or the other of fluid cylinders 42, 44 (FIG. 1). With the wing extensions fully extended, the plow assembly has a preferred overall length of approximately eleven feet. Further, as shown in FIGS. 18–23, extension of cylinders 204 and/or 206 causes forward pivotal movement of plow extensions 22 and/or 24 to the positions shown therein, thereby providing a substantial U-shape for the plow assembly allowing snow or other material to be pushed or carried from one position along a horizontal surface to another without the material slipping off the ends of the plow assembly. It is also possible to extend only one or the other of wing extensions 22, 24 such that the plow may be used with only one end extended or pivoted forwardly (as shown in FIG. 23), or one end extended with the opposite end extended and pivoted forwardly.

As shown in FIG. 24, each pair of fluid cylinders 200, 204 or 202, 206 is controlled by its own respective set of solenoid operated hydraulic valves and cooperating hydraulic relief valves or sequencing valves via electrical switches mounted in the cab of the plowing vehicle. A conventional hydraulic pump 250 creates hydraulic line pressure which is directed by an electric solenoid operated spool valve 252*a* or 252*b* through line 254*a* or 254*b* to the inner end of fluid cylinder 200 or 202, thereby extending piston rod 200*a* or 202*a* upon closure of an appropriate electrical switch in the vehicle cab by the vehicle/plow operator. This shifts solenoid valve 252*a* or 252*b* to the left or right, respectively, in FIG. 24. Once piston rod 200*a* or 202*a* is fully extended, the buildup of hydraulic pressure in line 254*a* or 254*b* activates hydraulic relief valve or sequencing valve 256*a* or 256*b* to allow fluid pressure through hydraulic line 258*a* or 258*b* to fluid cylinder 204 or 206, thereby causing extension of piston rod 204*a* or 206*a*, and thereby pivoting plow wing 22 or 24 forwardly as shown in FIG. 24. Thus, the plow operator may only need to depress a single switch causing fluid pressure to extend cylinder 200 or 202 and then subsequently cylinder 204 or 206 through the operation of relief valves 256*a*, 256*b*. Release of the switch causes solenoid valves 252*a*, 252*b* to return to their centered positions thereby holding fluid cylinders 200, 204, and/or 202, 206 in their extended and forwardly pivoted positions.

When return of wing extensions 22, 25 to their extended positions and subsequent retraction of slide members 170, 170' is desired, however, solenoid valve 252*a* or 252*b* is activated in the reverse direction by moving or depressing the appropriate electrical switch shifting the spool valve to the right or left, respectively, in FIG. 24. Hydraulic pressure is directed through lines 260*a*, 260*b* to the outer end of fluid cylinder 204 or 206, causing retraction of piston rod 204*a* or 206*a* and pivoting wing 22 or 24 to its extended position from its forwardly angled position. When piston rod 206*a*, 206*b* is fully retracted, increased hydraulic pressure in line 260*a*, 260*b* is directed through relief valve or sequencing valve 262*a*, 262*b* and lines 264*a*, 264*b* to the outer end of fluid cylinders 200, 202, causing retraction of piston rods 200*a*, 202*a* and hence, slide members 170, 170' including plow wings 22, 24. Again, such sequential retraction of the piston rods in the fluid cylinders occurs continuously without the necessity of the operator throwing separate switches through the operation of the relief valves 262*a*, 262*b*. If desired, electronic devices or switches, such as cam operated micro switches 285 (FIG. 4), may be mounted on housing 100 to deactivate actuators to stop extension of the actuators 200, 202 and slide members 170, 170', followed by activation of a separate switch to cause extension of cylinders 204, 206. The electronic switch is operable to deactivate the respective actuator 200, 202 in response to a threshold amount of movement of the plow wing (corresponding to the fully extended position or fully retracted position of the plow wing) along the rear surface of the plow. When the plow wing and slide reaches its fully extended position, the system is further operable (if the operator continues to depress the appropriate switch at the vehicle) to actuate the other actuator 204, 206 to automatically pivot the plow wing forwardly once it is extended. The micro switches may each include a flexible strap which extends through an aperture in housing 100 and flexes away from the plunger on an electrical switch when slide member 170, 170' is extended, but is flexed into contact with the switch plunger when the slide member is retracted. Clearly, other stop members or limit switches may be implemented to deactuate one actuator 200, 202, and subsequently or substantially simultaneously actuate the other actuator 204, 206, such that the plow wings are smoothly and continuously movable between the retracted and forwardly angled positions, without affecting the scope of the present invention.

As shown in FIG. 24, valving for operating the fluid cylinders 42, 44 to pivot the plow assembly about support 14 and axis 62 to the left or right is provided through solenoid operated valve 266 which is shifted to the right by operation of an electrical switch to angle the plow assembly to the left with fluid cylinder 42 through hydraulic line 270*a*, and shifted to the right through the reversal of the same switch to angle the plow assembly to the right with fluid cylinder 44 through hydraulic line 270*b*. Appropriate relief valves 272, 274 are connected, respectively, to lines 270*a*, 270*b* in the event pressure on the plow during plowing forces the plow in the opposite pivotal direction and creates extreme pressure within the hydraulic system.

Likewise, as shown in phantom in FIG. 24, a solenoid operated valve 276 and an electrically operated check valve 278 may be shifted to the left to activate and extend the lift cylinder 76 in the event such a cylinder is included on the support 14. Check valve 279 retains cylinder 76 in its extended position. Similarly, to retract cylinder 76, a solenoid operated valve 277 and a check valve 279 are shifted to the left, and check valve 278 holds cylinder 76 in its retracted position.

Therefore, the present invention provides a plow assembly which includes extendable and retractable wings which are also pivotable forwardly with respect to the main plow blade. Because the wings are mounted and movable along the rear surface of the main plow, the plow moldboard may provide a continuous, uninterrupted front surface for pushing material. By positioning the plow wings rearward of the main plow, the hinge and slide components of the plow wings of the present invention are protected behind the plow and thus are not exposed to the material being moved by the plow. This substantially improves protection of the movable components of the plow assembly, while providing a continuous front surface of the plow blade.

Although shown and described as including a pair of actuators 200, 204 and 202, 206 for extending and then pivoting each of the plow wings 22, 24, it is envisioned that extension and pivoting of each plow wing may be accomplished via extension of a single actuator. For example, an actuator may extend a certain distance to move the plow wing outwardly along the rear surface of the plow to a point of maximum allowable extension, whereby further movement is limited by a stop, such as stop pins or the like. Because subsequent extension of the plow wing is substantially precluded, further extension of the single cylinder will cause pivotal movement of the wing about the pivot axis toward the forwardly angled position. Pivotal movement of the wing prior to full extension of the wing is substantially precluded due to the plow wing being positioned along a rear surface of the plow, which prevents forward pivoting of the wing until the wing is extended beyond the outer edge of the plow. When the actuator is retracted, the plow wing will pivot back toward its aligned position as it is pulled inwardly by the actuator until the plow wing is again fully aligned and retracted with respect to the plow.

Additionally, it is further envisioned that the plow wing may include a mechanical locking mechanism (not shown), similar to the locking mechanism disclosed in U.S. Pat. Nos. 5,638,618 and 5,899,007, which prevents pivotal movement of the plow wing until the plow wing is first fully extended from the plow. Likewise, the locking mechanism may function to prevent inward retraction of the plow wing along the plow until after the plow wing has been fully pivoted back into its aligned position with respect to the plow. The locking mechanism may comprise any means for precluding rotation of the plow wing until full extension and then preventing retraction of the plow wing until full rotation of the plow wing back to the aligned position occurs, without affecting the scope of the present invention. Optionally, one or more springs or biasing members (not shown) may be mounted between the slide member and the plow, and exert a biasing force to resist pivotal movement of the plow wing until the wing is extended and the biasing force is overcome by the actuator (to avoid potential binding of the wing if it pivots while still in an at least partially retracted position along the rear of the plow). The biasing force is selected such that the slide members are fully extendable until they contact a stop, and then further extension by the actuator overcomes the spring force and pivots the plow wing forwardly. Such a spring may also function to absorb the shock or impact force of an obstacle impacting the rear of an extended plow wing as the plow is moving in reverse, thereby protecting the actuators from such a shock.

Although shown and described as hydraulic fluid cylinders with extendable and retractable rods, the actuators for the plow assembly of the present invention, whether a pair of actuators for each plow wing, a single actuator for each plow wing, or a single, double ended actuator for both plow wings, may comprise other means for extending and retracting or for pivoting. For example, the actuators 204, 206 may comprise an electronic or hydraulic rotary motor or other means for imparting relative rotation between two components about a hinge or pivot axis. Additionally, the actuators 200, 202, 204 and/or 206 may comprise a linear actuator with a ball and screw mechanism, or may comprise a rotary motor with a gear which engages a timing belt or other toothed, movable member, such that rotation of the motor imparts a generally linear movement of the movable member, thereby extending or pivoting the plow wings. It is further envisioned that the actuators may even be manually operated mechanical devices, such as a hand crank or lever, which may be operable to linearly or rotationally move one or both of the plow wings with respect to the main plow. Other means for imparting a linear or rotational movement to the plow wings may be implemented without affecting the scope of the present invention. In situations where an hydraulic cylinder is not implemented, an additional stop or locking mechanism may be desired to lock or retain the plow wings in the desired position, such that the wings are not pivoted when resistance is encountered by the plow as it is moved by the vehicle.

As will also be appreciated, it is also possible to support the plow assembly including main plow 12 and plow wings 22, 24 on a support other than support frame 14 and intermediate support 16 at the front of a vehicle. For example, should the plow be used on a grader or bulldozer, an overhead beam may include downwardly extending rods or other supports which engage rear mounting flanges 54, 56 from above to support the assembly in the normal horizontal position shown in the drawings. Other supports such as bulldozer type support arms extending from the rear of the plow to a support frame on a vehicle may also be used with this plow assembly.

While several forms of the invention have been shown and described, other forms will now be apparent to those skilled in the art. Therefore, it will be understood that the embodiments shown in the drawings and described above are merely for illustrative purposes, and are not intended to limit the scope of the invention which is defined by the claims which follow as interpreted according to the principles of patent law, including the Doctrine of Equivalents.

The embodiments of the invention in which an exclusive property or privilege is claimed are defined as follows:

1. A plow assembly for vehicles, said assembly comprising:

a plow having first and second ends, a front material engaging surface, and a rear surface opposite said front surface;

a support for attaching said plow to the vehicle;

a plow wing on said first end of said plow, said plow wing having inner and outer ends, a front material engaging surface, and a rear surface opposite said front surface, said plow wing being mounted for sliding movement along said rear surface of said plow at said first end between a retracted position in which said outer end of said wing is adjacent said first end of said plow and an extended position in which said outer end of said wing is spaced outwardly of said retracted position and said first end of said plow with said front surface of said plow wing being generally aligned with said front surface of said plow;

said plow wing including a hinge, said plow wing being pivotally mounted on said hinge for movement between said extended position and a forwardly angled position in which said front surface of said plow wing extends at an angle to said front surface of said plow; and at least one actuator connected to said plow wing, said at least one actuator being operable to move said plow wing between said retracted and said extended positions and further operable to move said plow wing between said extended position and said forwardly angled position.

2. The plow assembly of claim 1 including a slide which is movable along said rear surface of said plow, said plow wing and hinge being mounted on and movable with said slide.

3. The plow assembly of claim 2 wherein said slide is movably mounted to a slide support along said rear surface of said plow.

4. The plow assembly of claim 3 wherein said slide is telescopically mounted within a housing on said rear surface of said plow, said housing including an opening at an outer end thereof through which said slide extends to support said plow wing for sliding movement along said rear surface of said plow laterally outwardly from said opening, said slide being elongated and having a cross-sectional shape generally corresponding to the cross-sectional shape of said housing.

5. The plow assembly of claim 2 wherein said at least one actuator comprises a first actuator and a second actuator, said first actuator being operable to move said slide to move said plow wing between said extended and retracted positions, said second actuator being operable to pivot said plow wing about said hinge to move said plow wing between said extended and angled positions.

6. The plow assembly of claim 5, wherein each of said first and second actuators has two ends, one end of said first actuator being pivotally connected to said rear surface of said plow, the other end of said first actuator being pivotally connected to said slide, one end of said second actuator being pivotally connected to said slide, the other end of said second actuator being pivotally connected to said hinge.

7. The plow assembly of claim 6, wherein said hinge is pivotally connected to said slide along a generally vertical pivot axis, said other end of said second actuator being pivotally connected to said hinge at a distance from said vertical pivot axis.

8. The plow assembly of claim 7, wherein said other end of said first actuator is pivotally connected to said slide at a position spaced from the position at which said one end of said second actuator is pivotally connected to said slide.

9. The plow assembly of claim 8, wherein said first actuator has a first length and has a first extendable member pivotally connected to said slide and adapted to extend and retract a first distance for movement of said slide a distance corresponding to said first distance, said second actuator having a second length which is less than said first length and having a second extendable member pivotally connected to said hinge and adapted to extend and retract a second distance which is less than said first distance for pivotal movement of said plow wing about said generally vertical pivot axis.

10. The plow assembly of claim 5, wherein said first and second actuators are operable to move said plow wing between said retracted and forwardly angled positions via a smooth, continuous movement of said plow wing.

11. The plow assembly of claim 10, wherein said plow wing is movable between said retracted and forwardly angled positions via at least one sequencing valve interconnected with said first and second actuators.

12. The plow assembly of claim 10 further including a limit device which is operable to deactuate said first actuator and actuate said second actuator in response to a threshold movement of said plow wing along said rear of said plow.

13. The plow assembly of claim 1, wherein the vehicle has a longitudinal axis generally aligned with the direction of motion of the vehicle when traveling in forward or reverse, said support including a support frame for attaching said plow to the front of the vehicle, said plow being pivotally mounted on said support frame for movement about a first, generally vertical pivot axis from a centered position extending generally transverse to the longitudinal axis of the vehicle to a series of angled positions in which said plow is angled to the left or right of said centered position.

14. The plow assembly of claim 13, wherein said plow is pivotally connected to said support frame about a second, generally horizontal pivot axis to allow forward pivotal movement of said plow and plow wing in unison when at least one of said plow and plow wing encounter an obstacle during plowing.

15. The plow assembly of claim 14 including a third actuator for pivotally moving said plow and plow wing about said first pivot axis, said third actuator having two ends, one end pivotally connected to said support frame, the other end pivotally connected to said plow.

16. The plow assembly of claim 1, wherein said front surface of said plow provides a generally continuous surface, said hinge and said plow wing being positioned at least partially behind said plow.

17. The plow assembly of claim 1 further including at least one stop member which limits movement of said plow wing along said rear surface of said plow.

18. The plow assembly of claim 1 including a second extendable plow wing on said second end of said plow, said second wing being mounted for sliding movement along said rear surface of said plow at said second end between a retracted position in which said outer end of said wing is adjacent said second end of said plow and an extended position in which said outer wing end is spaced outwardly of said retracted position and said second end of said plow with said plow wing front surface generally aligned with said plow front surface, said second plow wing also including a second hinge, said second plow wing being pivotally mounted on said second hinge for movement between said extended position and a forwardly angled position in which said second plow wing front surface extends at an angle to said plow front surface.

19. The plow assembly of claim 18, wherein said at least one actuator comprises at least two actuators, at least one of said actuators being connected to said second plow wing and being operable to move said second plow wing between its retracted and its extended positions and being further operable to move said second plow wing between said extended position and said forwardly angled positions.

20. The plow assembly of claim 19 including a first slide and a second slide, said first and second slides being movably mounted along said plow, said first plow wing and hinge being mounted on and movable with said first slide, said second plow wing and second hinge being mounted on and movable with said second slide.

21. The plow assembly of claim 20, wherein said first and second slides are telescopically mounted within at least one housing on said rear surface of said plow, said housing including a pair of opposite openings therethrough through which said slide and said second slide extend to support said first and second plow wings for sliding movement along said rear surface of said plow.

22. The plow assembly of claim 21, wherein said first and second slides are each elongated and have a cross-sectional shape generally corresponding to the cross-sectional shape of said at least one housing.

23. The plow assembly of claim 20 further including at least one stop member which limits movement of said plow wing and said second plow wing along said rear surface of said plow.

24. The plow assembly of claim 20, wherein said at least two actuators include first, second, third and fourth actuators, said first actuator being operable to move said first slide and said plow wing between said extended and retracted positions, said second actuator being operable to move said plow wing between said extended and angled positions, said third actuator being operable to move said second slide and said second plow wing between said extended and retracted positions, said fourth actuator being operable to move said second plow wing between said extended and angled positions.

25. The plow assembly of claim 24 further including at least one limit switch which is operable to limit movement of said first and second slides along said rear surface of said plow via deactuation of at least one of said first and third actuators in response to a threshold amount of movement of a respective one of said first and second slides along said plow.

26. The plow assembly of claim 25, wherein said limit switch is further operable to actuate at least one of said second and fourth actuators in response to the threshold amount of movement of a respective one of said first and second slides along said plow.

27. The plow assembly of claim 24, wherein said actuators are operable to move a respective one of said plow wing and said second plow wing between said retracted and forwardly angled positions via a smooth, continuous sequential actuation of said actuators.

28. The plow assembly of claim 27, wherein said actuators are operable to move said respective one of said plow wing and said second plow wing between said retracted and forwardly angled positions via at least one first sequencing valve interconnected with said first and second actuators and at least one second sequencing valve interconnected with said third and fourth actuators.

29. The plow assembly of claim 24 wherein each of said actuators has two ends, one end of said first and third actuators being pivotally connected to said rear surface of said plow blade, the other end of said first actuator being pivotally connected to said first slide, the other end of said third actuator being pivotally connected to said second slide, one end of said second actuator being pivotally connected to said first slide, the other end of said second actuator being pivotally connected to said hinge, one end of said fourth actuator being pivotally connected to said second slide, the other end of said fourth actuator being pivotally connected to said second hinge.

30. The plow assembly of claim 29, wherein each of said first and second hinges are pivotally connected to said first and second slides along a corresponding generally vertical pivot axis, said other end of said second actuator being pivotally connected to said hinge at a distance from said corresponding vertical pivot axis, said other end of said fourth actuator being pivotally connected to said second hinge at a distance from said corresponding vertical pivot axis.

31. The plow assembly of claim 30, wherein said other end of said first actuator is pivotally connected to said first slide at a position spaced from the position at which said one end of said second actuator is pivotally connected to said first slide, said other end of said third actuator being pivotally connected to said second slide at a position spaced from the position at which said one end of said fourth actuator is pivotally connected to said second slide.

32. A plow assembly for vehicles, said assembly comprising:

a plow having first and second ends, a front material engaging surface, and a rear surface opposite said front surface;

a support for attaching said plow to the vehicle;

first and second extendable plow wings, each wing having inner and outer ends, a front, material engaging surface, and a rear surface opposite said front surface, said first wing being mounted for sliding movement along said rear surface of said plow at a first of said plow ends, said second wing being mounted for sliding movement along said rear surface of said plow at the second of said plow ends, each of said wings being movable between a retracted position in which said outer end of said wing is adjacent its respective end of said plow and an extended position in which said outer wing end is spaced outwardly of said retracted position and the respective end of said plow, each of said wings being generally aligned with said plow front surface when in said extended position;

each plow wing also including a hinge and being pivotally mounted on said hinge for movement between said extended position and a forwardly angled position in which said wing front surface extends at an angle to said plow front surface; and at least two actuators including at least one first actuator operable to move said first plow wing, and at least one second actuator operable to move said second plow wing, each of said plow wings being operable independently of the other plow wing such that said plow wings are independently movable between said respective retracted, extended, and forwardly angled positions, said plow wings forming a general U-shape with said plow when both plow wings are in their forwardly angled positions to facilitate pushing material being plowed without such material slipping off the plow ends.

33. The plow assembly of claim 32 including first and second slides movable along said rear surface of said plow, said first plow wing and said first hinge being mounted on and movable with said first slide, said second plow wing and said second hinge being mounted on and movable with said second slide.

34. The plow assembly of claim 33, wherein each slide is telescopically mounted within at least one housing on said rear surface of said plow, said at least one housing including first and second openings therethrough, said first slide extending through said first opening to support said first plow wing for sliding movement along said rear surface of said plow, said second slide extending through said second opening to support said second plow wing for sliding movement along said rear surface of said plow.

35. The plow assembly of claim 34, wherein each of said first and second slides is elongated and has a cross-sectional shape generally corresponding to the cross-sectional shape of said respective housing in which it is mounted.

36. The plow assembly of claim 33, wherein said at least one first actuator comprises a first pair of actuators and said at least one second actuator comprises a second pair of actuators.

37. The plow assembly of claim 36 further including at least one stop member which is operable to limit movement of said first and second slides along said rear surface of said plow via deactuation of at least one of said actuators of said first and second pairs of actuators and actuation of at least one other of said actuators of said first and second pairs of actuators in response to a threshold amount of movement of a respective one of said first and second slides along said plow.

38. The plow assembly of claim 36, wherein said first and second pairs of actuators are operable to move a respective one of said first and second plow wings between said retracted and forwardly angled positions via a smooth, continuous sequential actuation of said actuators.

39. The plow assembly of claim 38, wherein said actuators are operable to move said respective one of said first and second plow wings between said retracted and forwardly angled positions via at least one first sequencing valve interconnected with the actuators of said first pair of actuators and at least one second sequencing valve interconnected with the actuators of said second pair of actuators.

40. The plow assembly of claim 37, wherein each of said actuators has two ends, one end of one of said actuators in each pair being pivotally connected to said rear surface of said plow, the other end of said one actuator in each pair being pivotally connected to a respective one of said first and second slides, one end of the other of said actuators in each pair being pivotally connected to a respective one of said first and second slides, the other end of said other actuator in each pair being pivotally connected to a respective one of said first and second hinges.

41. The plow assembly of claim 40, wherein each of said first and second hinges is pivotally connected to its respective slide along a generally vertical pivot axis, said other end of said other actuator in each pair being pivotally connected to said respective hinge at a distance from said pivot axis.

42. The plow assembly of claim 40, wherein said first and second slides are aligned with one another along a common axis for extension and retraction, said first and second pairs of actuators also being aligned with one another on said rear surface of said plow.

43. The plow assembly of claim 33, wherein said first and second slides are movably mounted to at least one slide support on said rear surface of said plow.

44. The plow assembly of claim 32, wherein the vehicle has a longitudinal axis generally aligned with the direction of motion of the vehicle when traveling in forward or reverse, said support including a support frame for attaching said plow to the front of the vehicle, said plow being pivotally mounted on said support frame for movement about a first, generally vertical pivot axis from a centered position extending generally transverse to the longitudinal axis of the vehicle to a series of angled positions in which said plow is angled to the left or right of said centered position.

45. The plow assembly of claim 44, wherein said plow is pivotally connected to said support frame about a second, generally horizontal pivot axis to allow forward pivotal movement of said plow and plow wings in unison when at least one of said plow and plow wings encounter an obstacle during plowing.

46. The plow assembly of claim 45 including a fifth extendable actuator for pivotally moving said plow and said plow wings about said first pivot axis, said fifth actuator having two ends, one end being pivotally connected to said support frame, the other end being pivotally connected to said plow.

47. The plow assembly of claim 32, wherein each of said first and second ends of said plow are curved to correspond to a curvature of said front surface of said plow wings to close any gap between said front surface of said first and second plow wings and said first and second plow ends when said plow wings are angled forwardly.

48. A plow assembly for vehicles, the vehicle having a longitudinal axis generally aligned with the direction of motion of the vehicle when traveling in forward or reverse, said assembly comprising:

a plow having first and second ends, a front material engaging surface, and a rear surface opposite said front surface, said front material engaging surface of said plow having a generally continuous surface;

a support for attaching said plow to the vehicle;

first and second extendable plow wings, each wing having inner and outer ends, a front, material engaging surface, and a rear surface opposite said front surface, said first wing being mounted for sliding movement along said rear surface of said plow at a first of said plow ends, said second wing being mounted for sliding movement along said rear surface of said plow at the second of said plow ends, each of said wings being movable between a retracted position in which said outer end of said wing is adjacent its respective end of said plow and an extended position in which said outer wing end is spaced outwardly of said retracted position and the respective end of said plow, each of said wings being generally aligned with said plow front surface when in said extended position;

each plow wing also including a hinge and being pivotally mounted on said hinge for movement between said extended position and a forwardly angled position in which said wing front surface extends at an angle to said plow front surface;

first and second slides movable along said rear surface of said plow, said first plow wing and first hinge mounted on and movable with said first slide, said second plow wing and second hinge mounted on and movable with said second slide; and at least one actuator for each of said plow wings, said at least one actuator being operable to move each of said first and second plow wings, each of said d plow wings being operable independently of the other plow wing such that said plow wings are independently movable between said respective, retracted, extended, and forwardly angled positions.

49. The plow assembly of claim 48, wherein said plow is pivotally mounted on said support frame for movement about a first, generally vertical pivot axis from a centered position extending generally transverse to the longitudinal axis of the vehicle to a series of angled positions in which said plow is angled to the left or right of said centered position.

50. The plow assembly of claim 48, wherein said at least one actuator for each of said plow wings comprises a pair of actuators for each of said plow wings, one actuator of said pair of actuators for each of said plow wings being operable to move a respective one of said plow wings between said retracted and extended positions, another actuator of said pair of actuators for each of said plow wings being operable to move a respective one of said plow wings between said extended and forwardly angled positions.

* * * * *